US006123899A

United States Patent [19]

Setzer et al.

[11] Patent Number: 6,123,899

[45] Date of Patent: *Sep. 26, 2000

[54] MASTER ALLOY HARDENERS

[75] Inventors: William C. Setzer, Evansville, Ind.; Richard J. Malliris; Gary W. Boone, both of Henderson, Ky.; Frank P. Koch, Evansville, Ind.; David K. Young, Henderson, Ky.

[73] Assignee: KB Alloys, Inc., Sinking Springs, Pa.

[ * ] Notice: This patent is subject to a terminal disclaimer.

[21] Appl. No.: 08/401,043

[22] Filed: Mar. 8, 1995

Related U.S. Application Data

[63] Continuation of application No. 07/846,339, Mar. 6, 1992, Pat. No. 5,405,578, which is a continuation-in-part of application No. 07/666,213, Mar. 7, 1991, abandoned.

[51] Int. Cl.[7] ..... C22C 21/02; C22C 21/06; C22C 21/10; C22C 21/12

[52] U.S. Cl. ..... 420/590; 420/529; 420/540; 420/542; 420/548; 420/550; 420/552; 420/554

[58] Field of Search ..... 420/528–554, 420/590

*Primary Examiner*—Deborah Yee
*Attorney, Agent, or Firm*—Bachman & LaPointe, P.C.

[57] ABSTRACT

This invention relates to master alloy hardeners for use in preparing aluminum base alloys. The respective concentrations of the alloying elements in the master alloy hardener are a multiple equal to or greater than 2 of the concentrations of such elements in the base alloy, and the ratios of the alloying elements in the master alloy hardener to each other are the same as the ratios of the alloying elements in the base alloy. After the aluminum base alloy and the concentration of each alloying element therein are identified, a desired multiple of such concentrations is determined. An aluminum master alloy is prepared that contains the alloying elements at concentrations equivalent to such multiple of the corresponding concentrations of the elements in the base alloy. The master alloy hardeners are added to commercially pure aluminum to provide the desired base alloy.

31 Claims, 5 Drawing Sheets

MASTER ALLOY HARDENERS

CROSS REFERENCE TO RELATED APPLICATIONS

This application is a Continuation of U.S. patent application Ser. No. 07/846,339, filed Mar. 6, 1992, now U.S. Pat. No. 5,405,578, issued Apr. 11, 1995, which in turn is a Continuation-In-Part of U.S. Pat. application Ser. No. 07/666,213, filed Mar. 7, 1991, now abandoned, which is incorporated herein by reference in its entirety.

FIELD OF THE INVENTION

This invention relates generally to master alloys useful in the preparation of aluminum base alloys. More particularly, it relates to master alloy hardeners that contain the alloying elements of the base alloy at concentrations that are the same multiple of the concentrations in the base alloy. Thus, the ratio of the alloying elements in the master alloys is the same as the ratio of these elements in the base alloy, but the concentrations in the master alloys are higher.

BACKGROUND OF THE INVENTION

Most aluminum alloys contain several alloying elements to enhance the properties of the finished product. Such alloying elements include but are not limited to copper, magnesium, manganese, silicon, chromium, strontium, phosphorous, zirconium, zinc, and iron. These elements are added as pure metal, powders, or master alloys. The form of the addition is dictated by cost of the raw material, consistency, influence on melt quality, and dissolution rate.

Master alloys provide the desired alloying elements in more concentrated form than the concentration of such elements in the final aluminum base product. See U.S. Pat. No. 3,591,369 issued Jul. 6, 1971 to Tuthill, which is incorporated herein by reference.

Conventional aluminum master alloys are usually binary systems composed of two components only, such as aluminum and manganese as disclosed in the Tuthill patent. Some higher component master alloys are disclosed in the art. See U.S. Pat. No. 4,353,865 issued Oct. 12, 1982 to Petrus, U.S. Pat. No. 4,185,999 issued Jan. 29, 1982 to Seese et al., U.S. Pat. No. 4,119,457 issued Oct. 10, 1978 to Perfect, U.S. Pat. No. 4,104,059 issued Aug. 1, 1978 to Perfect, U.S. Pat. No. 4,062,677 issued Dec. 13, 1977 to Perfect, and U.S. Pat. No. 3,725,054 issued Apr. 3, 1973 to Perfect, all of which are incorporated herein by reference. However, these alloys have limited purposes and are designed to take advantage of available and less costly raw material alloy mixtures, such as strontium/silicon or ferro-silicon alloys.

Virtually all of the aluminum alloys encountered today are either ternary, quartenary, or of higher level composition. Thus, the production of commercial aluminum alloys generally involves the addition of pure metals and/or two or more binary master alloy hardeners to achieve the proper chemistry in the base heat. These multiple additions result in longer holding times in the furnace than desirable and may significantly reduce the recovery of critical alloying elements present in the final base alloy. In addition, purchasers of the binary master alloy hardeners obtain greater amounts of the aluminum base than they usually desire.

Often, a company that produces aluminum base alloys for fabrication into intermediate or final products will recycle production scrap in the process. In some instances, the scrap may be in a form that is readily recycled, but other forms of scrap can cause substantial metal loss if introduced in their original form into melting furnaces. The latter category includes machining chips, foil, and fine wire. These operations require several additions of pure metal or binary master alloy hardeners, which have the disadvantages mentioned above. Also, the addition of scrap to a conventional aluminum melting furnace, when the scrap is in a form with a high surface to volume ratio and has oil, paint, or other contaminants, generates large quantities of oxides. This reduces metal recoveries and requires additional melt treatment. When properly treated and melted, the recovery of both aluminum and alloying elements can be conserved and efficiently utilized.

Thus, there is a significant need for master alloy hardeners that contain concentrated amounts of all of the alloying elements in the proper proportions so that the final aluminum base alloy is obtained after the addition of only one type of master alloy hardener to commercially pure aluminum, recycled aluminum alloy production scrap, or a combination of the two. This would reduce furnace time by eliminating or limiting multiple pure metal and master alloy additions, would improve metal recovery from certain types of scrap, and would allow inventory reduction by providing more concentrated master alloys. The master alloys of the present invention overcome these deficiencies in the art.

SUMMARY OF THE INVENTION

It is an object of the invention to provide concentrated, multi-component master alloy hardeners for use in preparing aluminum base alloys.

A further object of the invention is to provide a method for preparing such master alloy hardeners.

Another object of the invention is to provide a method for using the master alloy hardeners to produce aluminum base alloys.

Still another object of the invention is to provide a system and apparatus for producing the master alloy hardeners.

Additional objects and advantages of the invention will be set forth in part in the description that follows, and in part will be obvious from the description, or may be learned by the practice of the invention. The objects and advantages of the invention will be attained by means of the instrumentalities and combinations particularly pointed out in the appended claims.

To achieve the objects and in accordance with the purpose of the invention, as embodied and broadly described herein, the present invention provides concentrated, multi-component (i.e., two or more alloying elements) master alloy hardeners for use in preparing aluminum base alloys. The respective concentrations of the alloying elements in any one of the master alloy hardeners are a multiple, equal to or greater than 2, of the concentrations of the alloying elements in the respective base alloy. Thus, the ratio of the concentrations of the alloying elements in the master alloy hardener is the same as the ratio of the concentrations of these elements in the base alloy. The number of alloying elements can range from 2 to 11 and preferably from 3 to 8. The multiple preferably ranges from 2 to 50 and more preferably from 3 to 30, provided the amount of aluminum in the master alloy hardener is kept as low as possible. It need not be a whole number. Preferably the base alloy is a wrought aluminum alloy selected from the 2xxx series, the 3xxx series, the 4xxx series, the 5xxx series, the 6xxx series, the 7xxx series, and the 8xxx series as designated by the Aluminum Association or a cast or ingot aluminum alloy selected from the 2xx series, the 3xx series, the 4xx series, the 5xx series, the 6xx series, the 7xx series, and the 8xx series as designated by the Aluminum Association.

The master alloy hardeners are prepared as follows. First, one identifies the aluminum base alloy to be prepared. Second, the concentration, in weight percent, of each alloying element in this base alloy is identified. Third, a desired multiple of concentrations of the alloying elements in the base alloy is determined. Once the desired multiple is chosen, the desired master alloy hardener containing the appropriate concentrations of the alloying elements is prepared. These concentrations are the multiple of the corresponding concentrations of these elements in the base alloy.

The master alloys are added to commercially pure aluminum, scrap base alloy, or a combination thereof to produce the desired new base alloy. For example, a master alloy that contains the desired alloying elements for the base alloy is added to commercially pure aluminum to produce the base alloy containing the specified elements at specified concentrations. A sufficient amount of the master alloy is added to the aluminum until the elements in the master alloy have been diluted by the commercially pure aluminum by a dilution factor equal to the multiple minus one.

The invention also comprises a system for the production of the master alloy hardeners. The system comprises: (1) identifying means for identifying the aluminum base alloy to be prepared; (2) determining means for determining each alloying element in the base alloy and its concentration; (3) calculating means for calculating the desired multiple of the concentrations of the alloying elements in the base alloy; and (4) preparing means for preparing an aluminum master alloy hardener containing concentrations of the alloying elements at the multiple of the corresponding concentrations of the elements in the base alloy.

The accompanying drawings, which is incorporated in and constitutes a part of this specification, illustrates one embodiment of the invention and, together with the description, serves to explain the principles of the invention.

DETAILED DESCRIPTION OF THE INVENTION

Figure 1:
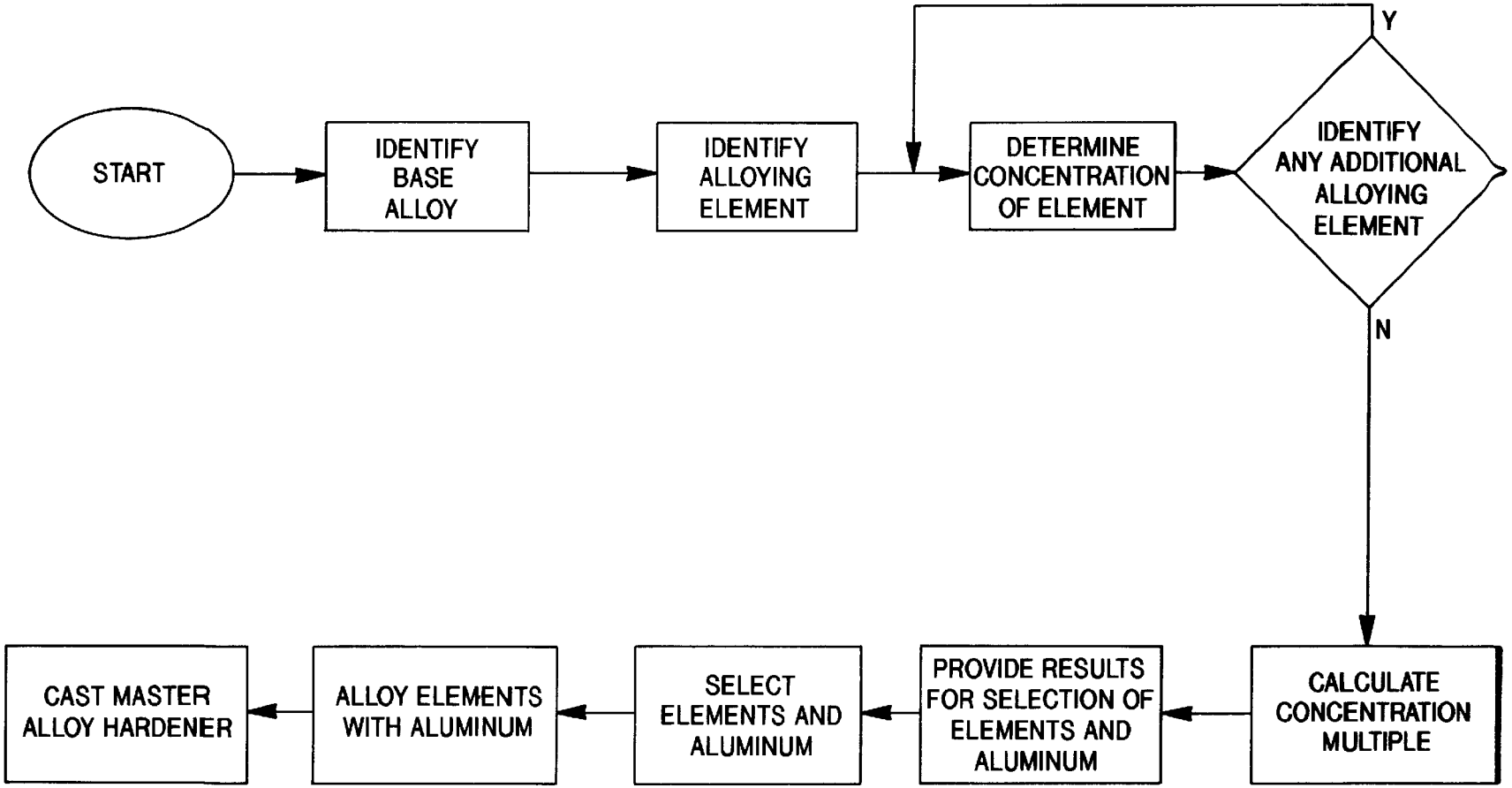
FIG. 1 is a flow chart showing the method and apparatus of the invention.

Reference will now be made in detail to the presently preferred embodiments of the invention, which, together with the following examples, serve to explain the principles of the invention.

The master alloy hardeners of the invention are used for preparing aluminum base alloys. (The master alloy hardeners of the invention are also referred to herein as master alloys.) Each master alloy contains the same alloying elements that are desired in the base alloy. Preferably, the master alloy also contains aluminum. Master alloy forms that contain only the alloying elements include powders and other rapidly solidified alloys, such as splatter. As used herein, the term "alloying element" means any purposeful addition of an element to a base metal, in this case aluminum, for the purpose of modifying the mechanical, corrosion, electrical or thermal characteristics or metallurgical structure of the base metal. The term does not include impurities.

The respective concentrations of the alloying elements in the master alloy are greater than the concentrations of such elements in the base alloy by a factor or multiple-of at least 2 and preferably 3 or more. For any given master alloy, the multiple is the same for each of the alloying elements. Thus, the ratios of the alloying elements in any given master alloy-aluminum base alloy pair is the same.

For example, given a hypothetical alloy of A—B—C—Al, if the selected base alloy is 1% A, 5% B, 10% C, and 84% Al, and the master alloy were a "4x" multiple of the desired nominal composition, the master alloy would be 4% A, 20% B, 40% C, and 36% Al. The ratios of A:B:C in both alloys are the same, 1:5:10, but the master alloy has 4 times the concentration of the alloying elements. Starting with a base heat of commercially pure aluminum, the addition of 1 part of the master alloy to 3 parts of the pure aluminum would provide the desired final aluminum base alloy. Thus, the addition of the master alloy to a quantity of the pure aluminum equal to the multiple, minus one, dilutes the alloying elements by the factor necessary to produce the base alloy with the desired concentration of alloying elements.

The composition of any particular master alloy depends upon the composition of the desired final commercial alloy. For any given aluminum base alloy, a master alloy of the invention can be prepared.

The compositions of virtually all of the commercial wrought, cast, or ingot aluminum base alloys found in the U.S. market today (other than custom made, special purpose alloys) have been categorized by the Aluminum Association, 900 19th Street, N.W., Washington, D.C. 20006. The current categories for wrought aluminum are found in the Association's book, *Aluminum Standards and Data* 1990, which is incorporated herein by reference. See especially Table 6.2: Chemical Composition Limits of Wrought Aluminum Alloys, which is reproduced here as Table 1. The current categories for cast or ingot alloys are found in the Association's *Registration Record of Aluminum Association Alloy Designations and Chemical Composition Limits for Aluminum Alloys in the Form of Castings and Ingots* (1987 edition), which is incorporated herein by reference. This information is reproduced here as Table 2.

Each of these two major categories (wrought and cast/ingot) is broken into series that are defined by the principal alloying element added to the aluminum (except for the first series, which contains varying grades of commercially pure aluminum). For example, for the 2,000 series of wrought aluminum base alloys, the principal alloying element is copper. However, each series has one or more additional alloying elements that characterize the series. The handbooks specify the identity of these elements as well as the composition ranges for all alloying elements in the series. See Tables 1 and 2.

The preferred aluminum base alloys that serve as a basis for preparing the master alloys of the invention are the 2xxx series, the 3xxx series, the 5xxx series, the 6xxx series, and the 7xxx series for wrought aluminum base alloys and the 201 alloy, 206 alloy, 3xx series, the 5xx series, and the 7xx series for cast or ingot aluminum alloys. The particularly preferred base alloys are shown in Table 3. For cast/ingot alloys, especially preferred alloys are 319, 356 and variants thereof, and 380, and 390. However, the master alloys of the invention are not limited to these specified alloys and series of alloys.

A master alloy can be prepared for any given aluminum base alloy. A particular base alloy is selected. The weight percent concentration of each alloying element in the base alloy will be known or can be identified by known techniques. The number of alloying elements can be anywhere from 2 to 11, but the greatest benefit is derived when the number of elements is 3 or more. Three to eight elements are particularly preferred. The preferred alloying elements include silicon, iron, chromium, zinc, copper, magnesium, manganese, nickel, lead, bismuth, and zirconium. The most preferred alloying elements are silicon, magnesium, copper, manganese, chromium, and zinc.

The target chemistry (i.e., the composition in weight percent for each alloying element) determines the ratios of the elements that are present in the base alloy, which ratios are maintained in the concentrated alloy. If the target composition is a range, then generally the middle of the range is chosen as the target. A desired multiplier for the base alloy is then determined, based upon the customer's specific requirements and metallurgical considerations. The multiplier preferably ranges from 2 to 50, more preferably from 3 to 30, and most preferably 3 to 10, provided that the amount of aluminum in the master alloy is kept as low as possible. For certain series of base alloys this will mean that the preferred multiple will be at the high end of the preferred range (or even as high as 66), whereas for other series of base alloys, the multiple will be at the lower end of the range. It can be a whole number or a decimal, such as 7.5. Within these ranges, the specific multiplier will depend upon the composition and characteristics of the selected final base alloy, cost factors relevant to the preparation of the final base alloy, cost factors relevant to the preparation of the master alloy, the chemistries of the alloying elements, and the interactions of these alloying elements in a melt. These factors are known or readily determinable by those skilled in the art, given the teachings contained herein. From an economic standpoint, the more concentrated or the higher multiplier alloys are more desirable.

The number of alloying element additions is determined by the number purposely added to make the final aluminum base alloy. Thus, the base alloy elements determine the elements in the master alloy. The concentration in the master alloy is determined by the customer's requirements and by the metallurgical characteristics of the particular base alloy contemplated. The concentrate multiplier in "dilute" base alloys with relatively low melting point element additions may range as high as 50–70 times the concentration of the base alloy. Master alloys of higher alloy content, or those which contain higher melting point elements, or those which produce a wide melting temperature range generally contain from 3 to 10 times the base alloying addition chemistry.

Most often it is desirable to make the multiplier as high as possible while maintaining adequate dissolution rates and preventing: (1) undue hardship in the manufacture of the master alloy, (2) inconsistency in its chemistry due to segregation during manufacturing, or (3) the necessity to process at unduly high temperatures due to phase diagram considerations.

For master alloys in the form of waffle or ingot, a constraint on the choice of the multiplier is the fact that, for any given base alloy-master alloy pair, the concentration of aluminum in the master alloy generally must be at least approximately 20%. Thus, the sum of the concentrations of the alloying elements must be equal to or less than about 80%. If the concentration of the aluminum in the master alloy is less than about 20%, it becomes very difficult to get high melting point elements into solution when making the master alloy and to get the master alloy into solution when making the base alloy.

For master alloys in the form of wire, foil, pellets, powder, or splatter, it is not always necessary that the concentration of aluminum in the master alloy be at least approximately 20%. For these forms of master alloys, under certain circumstances such as where there are mechanical mixtures of pure metal powders or alloyed powders, or where the casting operation is conducted so as to produce a rapidly solidified structure with a fine intermetallic structure, or where the sum total of the elements desired produces lower melting point phases that are readily dissolved in pure or scrap aluminum, it is not necessary and may even be undesirable to include any aluminum.

The master alloys of the invention are prepared by the application of known techniques to the teachings contained herein. Preferably, commercially pure aluminum, scrap aluminum alloy, or a combination thereof, is used as the starting material. A sufficient amount is used to provide the calculated final concentration of aluminum in the master alloy. The starting material is melted according to known techniques.

A sufficient amount of each of the alloying elements to provide the calculated final concentration of each element in the master alloy is added to the melt. For certain alloying elements, such as magnesium, an additional amount beyond the calculated amount must be added to allow for melt losses either in the preparation of the master alloy or the preparation of the base alloy. Such an additional amount is readily determinable by a person skilled in the art, given the teachings contained herein, based upon such person's familiarity with the particular alloys involved and knowledge of historical data for the amounts lost in working with the particular elements and alloys. If the starting melt contains scrap alloy, the amount of alloying elements in such scrap will need to be taken into account. In addition, if the commercial aluminum being used to prepare the master alloy and/or base alloy contains impurities that would add to the concentration of a purposeful addition alloying element in the final base alloy, such impurities must be taken into account.

The precise means, sequence, and temperature at which each of the alloying elements is added will be readily determinable by those skilled in the art, once given the teachings contained herein. Such persons will look to such things as phase diagrams for particular alloys, other sources of information about the properties of the alloying elements, and the teachings contained herein. For example, when scrap aluminum alloy is used in the base melt, the alloying elements are generally added through a protective cover to prevent their oxidation. This protective cover is generally in the form of an inert gas or salt flux. Preferably, the salt is $MgCl_2$ when magnesium is one of the elements present or added. In the processing of alloys containing second phase intermetallic particles in the liquid state, such as $MnAl_6$, $MnAl_4$, $Mg_2Si$, or $CuAl_2$, a key factor for producing an acceptable product is maintaining a stirring action during both the processing of the product and the casting phase.

Otherwise, settling due to gravity segregation occurs, and the product does not achieve the desired uniformity of chemistry.

The temperature range at which the elements will be added will vary considerably, depending on the particular chemistries involved and the sequence by which the elements are added. The range is constrained only by the need to keep the metal molten until all of the elements are added and the need to prevent excessive oxidation. The elements will be kept in solution or suspended as fine intermetallic compounds in the molten aluminum. Preferably, the elements are added in a sequence in which the elements depress the melting point of the mixture or at least do not cause a significant increase in the melting point. Such melting point information is well known to or readily determinable by those skilled in the art, given the teachings contained herein.

After the final element is added and the molten master alloy has been formed, it is cast. The master alloy may be further processed or the final step in its preparation may be modified so as to produce master alloys in any desirable form. Such forms include foil, waffle, ingot, button, rod, wire, pellet, powder, briquet, and splatter. The preferred forms for the master alloys of the invention are waffle, ingot, powder, splatter, and pellet.

Grain refiners and modifiers can be added to the master alloy for providing certain desirable properties to the base alloy. Preferably, such materials are not added to the melt or the master alloy under preparation. Instead, they are physically combined with the master alloy by casting the master alloy around the refiner or modifier so that it physically surrounds the refiner or modifier but does not cause it to melt. This prevents the elements in the grain refiners and modifiers from chemically mixing with the master alloy hardener, which we have found would provide undesirable effects on the grain refiner or modifier.

More specific guidelines for the manufacture of a master alloy of the invention are as follows. First, a target chemistry for the base alloy is determined. The target chemistry comprises the particular elements that are to be purposefully added and their concentrations in weight percent.

Next, the total weight percent of these elements are added up, discounting impurities such as iron or silicon, unless these elements are specifically required in the diluted (base) alloy. In the case of a base alloy containing purposeful additions of iron and silicon, it is desirable to know the iron and silicon content of aluminum being used to prepare the master alloy, and also the iron and silicon content of the aluminum that is used to dilute the master alloy back to the final commercial base alloy so that corrections can be made. For example, commercial purity aluminum, identified as P1020, typically contains 0.07% silicon and 0.15% iron. If the final alloy is to be made with P1020 aluminum, the master alloy hardener must make allowances. If the final chemistry is 0.60% iron, then it would only be necessary to add 0.45 iron to the final diluted alloy, or the multiple of 0.45% iron in the master alloy in order to achieve the final desired iron level. Once adjustments are made, the sum total of the purposeful additions is calculated.

At this point, it is desirable to examine the chemistry and pick out the main alloying element. This element then is used to decide what guidelines are to be used to determine how the master alloy can be manufactured, based upon existing information developed for commercial binary hardeners. For example, most binary hardeners contain up to 50% of the hardener element, e.g., copper, silicon, magnesium, or manganese, etc. Therefore, the master alloy with one of these elements as the main ingredient would be examined and aluminum "added" to the total that would correspond to equal parts of aluminum and the major ingredient. For example, in a final alloy containing 1% magnesium, an equal part or 1% aluminum would be added to the total. If it was 2% copper, 2% would be added to the total. If 7% silicon, 7% would be added to the total. This grand total of elemental additions, including the aluminum, is then divided into 100 to determine a possible master alloy ratio which can either be adjusted up or down, depending upon the specific manufacturing requirements or knowledge about dissolution rates, etc. This practice then determines the starting master chemistry.

At this point, if one again looks at the binary phase diagram, and takes into consideration other parameters such as cost of holding time, furnace operating temperatures, recovery, etc., one can estimate a thermal practice using the binary aluminum/x phase diagram for the major alloy element to determine the temperature at which this element will be taken into liquid solution under equilibrium conditions. Since secondary additions tend to depress the solutionizing temperature, this becomes a conservative estimate of the temperature to which the molten aluminum alloy needs to be raised before a single phase liquid solution can be achieved. At this point, one has the option of either raising the temperature to reduce the overall time required to achieve dissolution or maintaining this temperature and increasing the holding time (while adding the major ingredient to allow it to go into solution).

It is desirable to put the least active alloys or elemental materials in first, followed by the most active, even if the active element is the major addition. For example, in the case of silicon and magnesium, silicon is added first because, if the addition of magnesium were made first, it would rapidly oxidize if held for a long period of time.

Secondary elements are generally added at a later point in time. If they have a low melting point, they tend to go into solution quickly and can be used to lower the temperature prior to casting. If transition elements are a part of the secondary addition, they may either be added as elemental materials during the addition of the primary element or they may be added as hardeners (in order to provide assurance of proper phase disposition) that have been manufactured at an earlier date.

There may be sources of raw materials that are not elemental but are economically desirable, such as aluminum scrap or 70:30 brass turnings (70% Cu plus 30% Zn), or other combinations of materials that take advantage of the fact that, with these master alloy hardeners, it is not necessary to manufacture a product from high purity elemental additions.

In some cases, it has even been found that it is not desirable to add an element to the heat if it has a specific purpose or function other than being present to assure the desired chemistry in the final product. Two examples are grain refiner additions and modifier additions, which are minor additions that are added to the final product in order to control microstructural features such as grain size and/or primary silicon disposition. In this case, it has been found desirable to produce the commercial grain refiner or modifier product separately in the form of rod, buttons, or other forms and introduce these into the mold with the master alloy being cast around and over them to mechanically entrain them without causing their dissolution. In this manner, these agents can be provided in an inactive state, which only becomes activated after the master alloy has been diluted by the user to its final chemistry.

After all of the elements have been added, it is desirable to immediately adjust the temperature so as to provide fluidity for casting and, depending on furnace stirring characteristics, provide a product that, when cast, is of consistent chemistry from the beginning to the end of the heat so as to remove concerns about segregation.

As mentioned previously, master alloys of the invention may be prepared by using scrap aluminum production alloys as the base. For example, in the production of cast or forged aluminum wheels, typically up to one-third machining scrap chips are developed during the final fabrication steps. This scrap could be melted down and alloying ingredients added to produce an alloy with three times the nominal chemistry for the alloy in question. This would permit the machine scrap to be added back in combination with pure aluminum to produce an alloy of the desired chemistry without any significant changes in chemistry once the melt has been produced. In this situation, the scrap processing would require the development of a molten heel, and an inert gas, or a molten salt cover through which the chips and alloying additions are made. Such a protective cover would prevent the oxidation of the chips and/or reactive elements, such as magnesium. In the case of salt covers where oxide is already present, such oxide tends to dissolve in the salt cover material rather than be mechanically entrained in the alloy.

It should be recognized that, in certain instances, it may be desirable not to add one or more of the alloying elements to the master alloy. One case would be where the element is very poisonous, such as antimony. That element can be added by the manufacturer of the final base alloy, which will have the proper facilities and permits for handling such an element. Another case might be an element that burns off easily, such as phosphorous. It would be easier and more efficient for this element to be added by the manufacturer of the base alloy.

The invention also comprises an apparatus or system for preparing the master alloy hardeners. The system comprises: (1) identifying means for identifying the aluminum base alloy to be prepared; (2) determining means for determining the concentration, in weight percent, of each alloying element in the aluminum base alloy identified by the identifying means; (3) calculating means for calculating the desired multiple of the concentrations of the alloying elements in the base alloy provided by the determining means; and (4) preparing means for preparing an aluminum master alloy hardener containing concentrations of the alloying elements at the desired multiple of the corresponding concentrations of the elements in the base alloy provided by the identifying means, determining means, and calculating means. See FIG. 1.

The identifying means, determining means, and calculating means can be any means for identifying the base alloy, determining the concentrations of the alloying elements, and calculating the desired multiple as previously described herein. These means include the analysis and selection of appropriate base alloys by persons skilled in the art using, for example, calculators and computers having appropriate computer programs or any appropriate written system. Computers include standard personal computers, such as IBM or IBM compatible PCs.

The preparing means for preparing the master alloy comprises:

melting means for melting a sufficient amount of commercially pure aluminum, scrap aluminum alloy, or combination thereof to provide the calculated final concentration of aluminum in the master alloy hardener;

mixing means for mixing a sufficient amount of each of the alloying elements into the molten aluminum, or the molten scrap aluminum alloy to provide the calculated final concentration of each of the elements in the master alloy hardener, wherein the elements are mixed at a temperature sufficient to keep the elements in solution or suspended as fine intermetallic compounds in the molten aluminum or the molten scrap aluminum alloy, thereby forming the molten master alloy hardener; and casting means for casting the master alloy hardener.

Accordingly, the preparing means includes the usual furnaces, crucibles, mixers, and other supporting hardware known to those skilled in the art. Thus, as used herein, the term melting means includes furnaces and other apparatuses for melting aluminum known to those skilled in the art. The term mixing means includes stirrers and other apparatuses for mixing or stirring a melt known to those skilled in the art. The term casting means includes apparatuses for casting the molten master alloy as known to those skilled in the art.

The master alloys are used in the preparation of final aluminum base alloys. For example, for a single melting furnace system, where the metal is cast from the melting furnace, the base heat is prepared, using commercially pure aluminum, scrap aluminum alloy, or a combination of the two. Sufficient material is added until the basic heat weight is achieved, less the requirement for the master alloy. The heat is raised to the proper super heat point above the melting point, which is typically between 1300° F. and 1400° F. Then sufficient master alloy material is added to achieve the desired final chemistry. Typically, the surface is skimmed clean of oxide before the master alloy addition is made. Additional small additives, such as grain refiners and modifiers can be added later to provide transient properties. In addition, under the Aluminum Association's tables on allowable composition limits, certain other minor additions may be made where it has been learned that they provide additional benefit. These include but are not limited to B, Sr, Ti, Be, Na, Ca, P, and Sb.

Alternatively, the master alloys can be added to the metal in a holder furnace as the metal is being poured in. This provides stirring action and minimizes the time and temperature for making alloying additions, thereby minimizing oxidation or stratification of some alloying elements.

In still another alternative, the master alloys can be added outside of the furnace, i.e., to a transfer trough. This would keep unwanted elements out of the furnace.

Thus, the master alloys also permit the starting and finishing temperatures to be more consistently controlled so as to target the desired casting temperature in the furnace once the master alloy has been added. This minimizes the amount of time required to complete the melting cycle prior to casting.

It should be recognized that the master alloys of the invention can be used to convert one type of aluminum base alloy to another type. Instead of adding the master alloy to either pure aluminum or starting material that is the same alloy as the desired final alloy, the master alloy can be added to starting material that has some but not all of the alloying elements of the desired final aluminum base alloy. For example, if the starting base alloy is Al—A—B, and the desired final alloy is Al—A—B—C, a master alloy can be prepared. It would have the composition Al—A—B—C with the concentrations of A, B, and C being such that they take into consideration the relative amounts of alloying elements in the starting base alloy such that they are a multiple (2 or more) of the desired concentrations of these elements in the final alloy. An additional amount of A, B, and/or C may need to be added to account for elemental loss in the conversion. The actual amounts for any given alloy pair and conversion are readily determinable by persons skilled in the art, based upon their historical experience working with a particular system. A sufficient amount of this master alloy, plus a portion of pure aluminum, if allowed for, is added to the starting base alloy to obtain the final base alloy.

The master alloys provide several advantages over conventional master alloys. First, they provide concentrated amounts of essentially all of the alloying elements in the proper proportions that are required to produce the specific final base alloy, thereby allowing the desired composition to be reached with the addition of only one alloying product. Second, they make more effective use of recycled scrap by enhancing its alloy content and putting it in a form that improves overall recovery of the product. Third, they reduce the amount of aluminum present in the hardener products. Fourth, they provide improved solution rates, thereby reducing furnace cycle time. Fifth, they reduce losses. Sixth, they reduce melt treatment time. Seventh, they provide, in certain instances, more consistent chemistry control. These advantages result in increased efficiency and decreased manufacturing costs for producers of final aluminum base alloys.

It is to be understood that the application of the teachings of the present invention to a specific problem or environment will be within the capabilities of one having ordinary skill in the art in light of the teachings contained herein. Examples of the products of the present invention and processes for their preparation and use appear in the following examples.

EXAMPLE 1

Preparation of Master Alloy for 2024 Alloy

Aluminum alloy 2024 contains nominally 4% copper, 0.65% manganese, 1.45% magnesium, and the balance aluminum. A 10X multiple master alloy, containing 40% copper, 6.5% manganese, 14.5% magnesium, and the balance aluminum was prepared. The following materials were used: 88 pounds of aluminum, 38 pounds of magnesium, 15.5 pounds of manganese, and 95 pounds of copper. Fifty-eight pounds of aluminum were melted by heating in a crucible to a temperature of 1220° F. The melt was heated further, and 95 pounds of copper were added at 1250° F. The solution was heated to 1700° F., and 15.5 pounds of manganese were added. The melt was heated to 1850° F., whereupon probing of the bottom of the crucible indicated that the manganese was all reacted and/or in solution. This was 90 minutes after the addition. Thirty-eight pounds of aluminum ingot were then added to chill back the melt quickly to 1500° F. Then, 38 pounds of magnesium ingot were added at 1500° F. The melt was heated to 1450° F. and cast off at 1450° F. A 6X 2024 master alloy was also prepared in a similar manner.

EXAMPLE 2

Preparation of Master Alloy for 7075 Alloy

Aluminum alloy 7075 contains nominally 1.6% copper, 2.5% magnesium, 0.23% chromium, 5.6% zinc, and 90.07% aluminum. A 7.5X multiple master alloy would be prepared as follows. Pure metals are used except for chromium, which could be added as a pure metal or in the form of 20% Cr/Al hardener. Consequently, the 7.5X master alloy would require 12% copper, 18.75% magnesium, 42% zinc, 18.625% pure aluminum, and 8.625% of the Cr/Al hardener. In this example, the chromium or chromium hardener and the aluminum would be added to the furnace and heated to 1550° F., whereupon the copper would be added. The melt would be held at this temperature until all the copper dissolved or reacted. Zinc would be added until the temperature of the melt dropped to 1400° F., and then the magnesium would be added. At that stage, the balance of the zinc would be added while maintaining the melt temperature at 1400° F. by balancing the heat input to the furnace. If the metal were sufficiently fluid for casting at 1400° F., it would be cast off at 1400° F. Alternately, if the melt were not fluid at 1400° F., the temperature could be progressively raised to improve fluidity for casting to the point where the melt would be castable. The melt would then be cast from that temperature.

EXAMPLE 3

Preparation of Master Alloy for 356 Alloy

Aluminum alloy 356 contains nominally 0.3% magnesium, 7% silicon, and the balance aluminum. A preferred chemistry allowed by the Aluminum Association of America contains up to about 0.02% strontium and 0.2% titanium in order to alter and improve the microstructure in the finished product. Previous experience with the Al—Si system and the high liquidus temperature with increasing Si content suggested the desirability of a 7X multiple alloy with magnesium at 2.1% and silicon at 49%. Preferably, this alloy would also contain 0.14% strontium added as 1.4% of a 10% Sr/Al hardener and 1.4% titanium as metallic titanium sponge, with 47.36% aluminum. In order to make this alloy, all (47.36%) of the aluminum would be melted in a furnace and heated to 1500° F. At this point, 6% of the silicon would be added and allowed to dissolve while the melt was cooling to nominally 1400° F. At 1400° F., all of the magnesium (2.1%) would be added and the melt heated to 1500° F. Once 1500° F. had been reached, all of the titanium sponge would be stirred in and the temperature raised to around 2100° F. whereupon the balance of the silicon would be added. The melt would be held at this temperature until all of the silicon has either dissolved or reacted. The alloy would then be cast at this temperature into molds containing 1.4% of the 10% Sr/Al master alloy.

When it is desired, boron could be added to provide a grain refiner containing product. In this case, the multiple alloy in this example would also contain from about 0.03 to 0.1% boron.

EXAMPLE 4

Preparation of Master Alloy for 6061 Alloy

Aluminum alloy 6061 contains nominally 0.6% silicon, 0.22% copper, 1% magnesium, and 0.20% chromium. A 25X multiple master alloy would be comprised of 25% magnesium, 15% silicon, 5.5% copper, and 25% of a 20% chromium/aluminum hardener, with the balance (29.5%) aluminum. Alternatively, elemental chromium could be used. The aluminum and chromium or chromium hardener would be placed in a furnace and heated to 1650° F., whereupon all of the silicon would be added. The temperature would be held at 1650° F. until all of the silicon had dissolved or reacted. The temperature of the melt then would be allowed to cool to 1500° F. and all the magnesium would be added in five approximately equal increments. If the addition of magnesium caused the heat to become thick, the temperature would be raised until the fluidity becomes acceptable. The procedure would be repeated until all of the magnesium was added. Once all of the magnesium was added and the material was sufficiently fluid to cast, the melt would be cast.

EXAMPLE 5

Conversion of Used Beverage Container Stock

Used beverage container stock (UBC) is comprised of approximately 90% body stock (usually Alloy 3004) and 10% lid and tab stock (usually Alloy 5182), which is recycled back into body stock. For economic purposes, it is desirable to use the maximum amount of UBC. However, assuming a 90/10 ratio, because of the different chemistries of 3004 and 5182, only 74% UBC can be used in alloy 3004. The balance must be made up from pure aluminum plus alloying ingredients. Assuming the following chemistries: 3004=0.12% Cu+1.1% Mn+1% Mg, balance Al and 5182 with 0.15% Cu+0.30% Mn+4.5% Mg, balance Al, the UBC mix would give an alloy containing 0.123% Cu+1.02% Mn+1.35% Mg. For 3004, the controlling element is Mg, and 1.35% Mg (X)+(1−X)×0% Mg=1% Mg×100 or 74% UBC could be used. In other words, 26% pure aluminum or Al—Cu—Mn scrap alloyed to contain 0.1115% Cu and 1.32% Mn, for immediate conversion to 3004 would be required.

With a Cu to Mn ratio of almost 12:1, these elements could be supplied, for example, at a concentration of 45:1 either as a multiple hardener with 60% manganese, 5.04% copper, balance aluminum or with a higher concentration, such as 56.3 to 1, providing 75% manganese, 6.23% copper, balance aluminum. Also, it is envisioned that these compositions could be in briquet form or could be provided as copper, manganese, and aluminum powder alloys or powder mixtures as well as appropriate fluxes contained therein.

If the conversion of UBC were to 5182 end stock Mn is the controlling factor and 1.02 Mn (X)+(1−X)×0% Mn=0.3% Mn×100 or 29% UBC could be used. In other words, 71% pure aluminum would be required to be alloyed to contain a minimum of 0.16% Cu and 5.79% Mg or a Mg to Cu ratio of 36.2:1. With this ratio those elements could be supplied for example at a concentration of 8.6:1 in conventional waffle or other forms.

EXAMPLE 6

Preparation of 30X 6061 Master Alloy Hardener

A 30X 6061 master alloy hardener was prepared as follows. First, 866 pounds of aluminum were added to a silicon carbide induction furnace, and the temperature was stabilized at 1400° F. Then, 24 pounds of chromium were added, followed by 6–8 pounds of potassium chloride flux cover. Next, 150 pounds of copper and 360 pounds of silicon metal were added, after which the temperature was driven to 1800° F. At this temperature, the silicon went into solution. Once all the silicon was in solution, 3–4 pounds of magnesium chloride were added as a protective cover. Then, 600 pounds of magnesium were added while stirring vigorously. This dropped the temperature to 1545° F., after which the melt was reheated to 1700° F. and cast into nominally 17 pound waffle ingot. All numbers are based upon a nominal 2000 pound heat.

EXAMPLE 7

Preparation of 4.5X 350 Master Alloy Hardener

A 4.5X 350 master alloy hardener was prepared as follows. First, 37.73 pounds of aluminum were melted in a silicon carbide furnace at a temperature of 1550° F. Next, 22.3 pounds of copper were added 1550° F. Then, 1.7 pounds of cobalt were added at a temperature of 1550° F., 1.7 pounds of magnesium were added at a temperature of 1600° F., and 7.0 pounds of nickel were added at a temperature of 1600° F. The temperature was raised to 2000° F. Then 5 pounds of potassium-titanium-fluoride ($K_2TiF_6$) and 2.6 pounds of sodium-zirconium-fluoride were added to the melt to achieve the desired titanium and zirconium levels. After the titanium and zirconium reacted, the spent salt was poured off. Next, 28.95 pounds of aluminum ingot were added, causing the temperature to drop to 1400° F. The temperature was taken to 2000° F., and the heat was cast.

EXAMPLE 8

Evaluation of Master Alloy Hardeners

Several master alloys of the invention were prepared and evaluated to characterize them by their microstructure, chemical composition of the intermetallic phases, and dissolution rates. The following alloys were evaluated: 30X 6201, 4X 3XX(SPECIAL), 4.5X 350, 7X A356, 16.5X 380/380, 5X 380.1, 4X 383.2, 10X 2124, 33X 3003, 40X 3003, 8X 5182, 30X 6061, 30X 6063, 7X 7150, 10X 7475, and 66X 8111.

Methodology

A scanning electron microscope (SEM) equipped with an energy dispersive x-ray (EDX) detector was used to characterize the microstructure and to identify the chemical composition of the intermetallic phases present in each of the master alloy hardeners. Specimens were prepared for examination by grinding and polishing to a mirror-like surface using conventional metallography techniques. A specimen was irradiated with a focused electron beam, which was repeatedly swept as a raster over the specimen. As the electron beam impinged on the specimen surface, various signals were produced, including secondary electrons and x-rays having characteristic energies. These signals were used to examine several characteristics of the specimen, including surface topography and chemical composition. The secondary electron emission was used to obtain high resolution images of the specimen surface. The x-rays, which have an energy level characteristic of the element(s) present in the sample, were used to determine the chemical composition of the intermetallic phases.

Dissolution rates for the master alloy hardeners were determined in accordance with the Aluminum Association's Standard Test Procedure for Measuring the Dissolution of Aluminum Hardeners, TP-2, 1990, which is incorporated herein by reference. The procedure consists of adding one part master alloy hardener to (x) parts of molten P1020 aluminum, where (x) is the multiple of the master alloy hardener minus one. The temperature of the molten aluminum was 725° C. in most cases, except as otherwise indicated. Analytical samples were taken prior to and following the addition of the master alloy hardener at selected time intervals. The samples were analyzed for chemical composition using an optical emission spectrometer. The weight percent of each alloying element was plotted as a function of time. Electrical conductivity was measured using an eddy current conductivity meter. The electrical conductivity measurements (as a percent of the International Annealed Copper Standard (IACS)) of the alloy being prepared were plotted as a function of time.

The various master alloy hardeners were prepared in accordance with the method of the invention by determining the target chemistry (i.e., purposeful alloying elements and their concentration in weight percent) of the final base alloy, determining the concentration multiple for the hardener, and thereby determining the target chemistry of the master alloy hardener. The actual chemical composition of the master alloy hardeners and the final base alloys were determined by standard techniques and are given below. All composition amounts are in weight percent.

Master Alloy Hardeners 30X 6201 Master Alloy Hardener

A specific alloy 6201 chemistry is composed of the following elements: 0.8% Mg, 0.7% Si, 0.003% B, 0.006% Sr, and 98.5% Al. Therefore, the target composition of the 30X 6201 master alloy hardener was 24% Mg, 21% Si, 0.075% B, 0.02% Sr, and 55% Al. The actual chemistries for this hardener were 24.1% Mg, 21.7% Si, 0.07% B, 0.015% Sr, and 54.1% Al. When diluted with commercial aluminum to form 6201 alloy, the actual chemistries of that alloy were 0.80% Mg, 0.72% Si, 0.002% B, 0.005% Sr, and 99.12% Al.

This information permits calculation of the elemental recoveries for the master alloy hardener and the final base alloy. For the master alloy, the percent recovery for any element is calculated as follows. Dividing the actual concentration for the element in the master alloy hardener by the target concentration for the element in the master alloy hardener and then multiplying by 100 provides the recovery for the element in the hardener. For the base alloy, the percent recovery is determined by dividing the actual composition of the element in the final base alloy by the target composition and then multiplying the result by 100.

Figure 2:
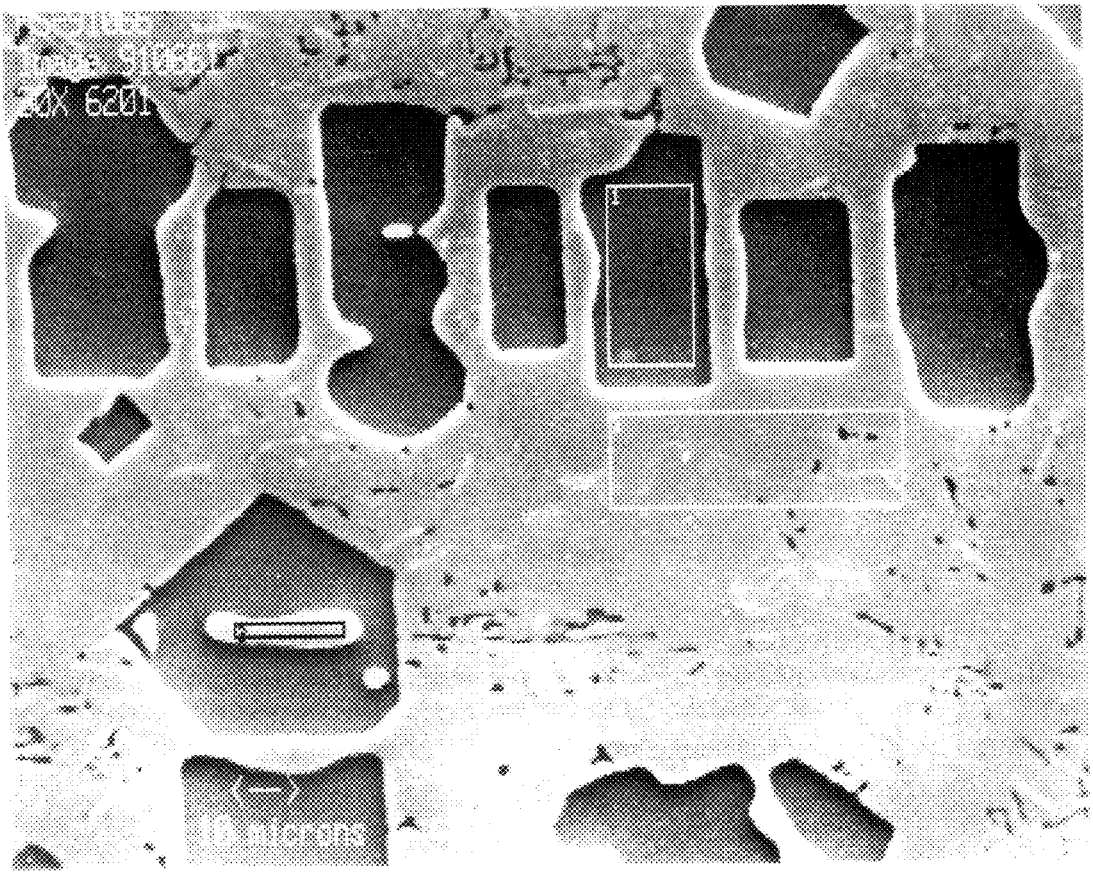
FIG. 2 is a scanning electron microscope (SEM) micrograph of the master alloy hardener 30X 6201, which shows the alloy's microstructure, which includes three different phases.
Figure 3:
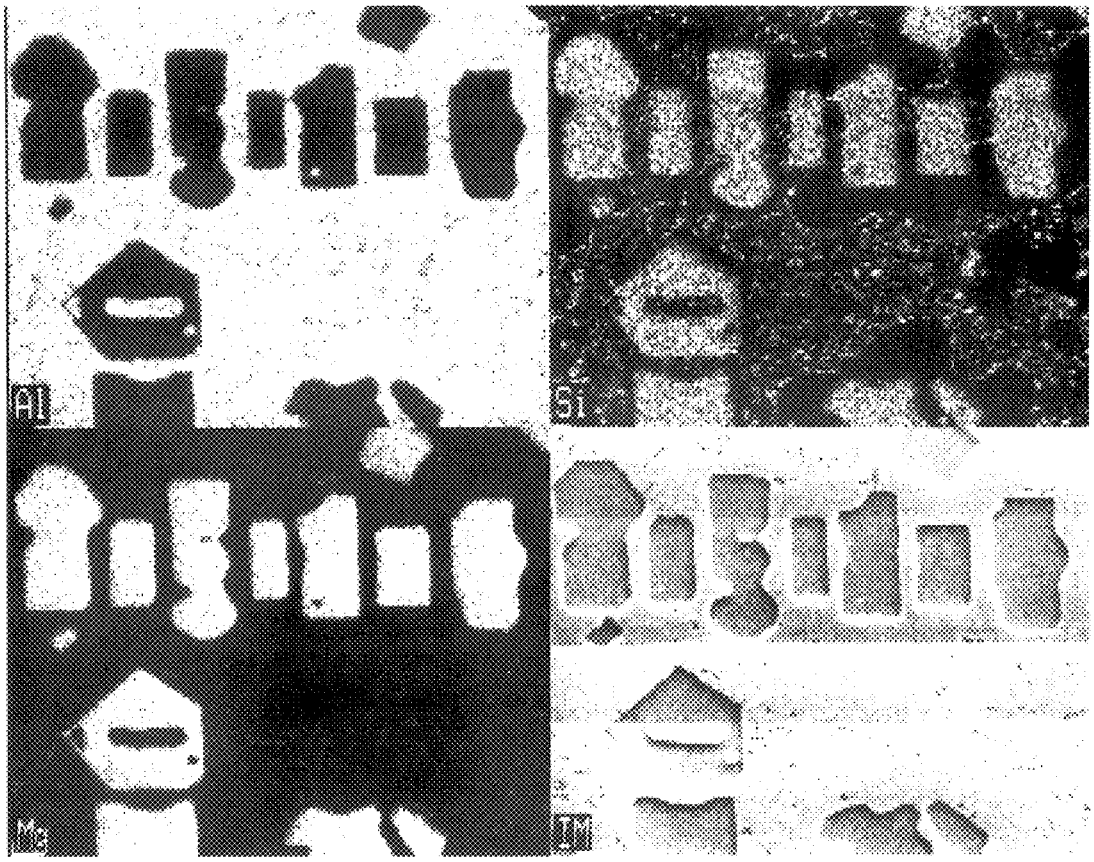
FIG. 3 is an energy dispersive X-ray micrograph of the 30X 6201 master alloy hardener showing the predominant chemical composition of the three phases. The fourth picture, designated IM, is the SEM micrograph of the sample.
Figure 3A:
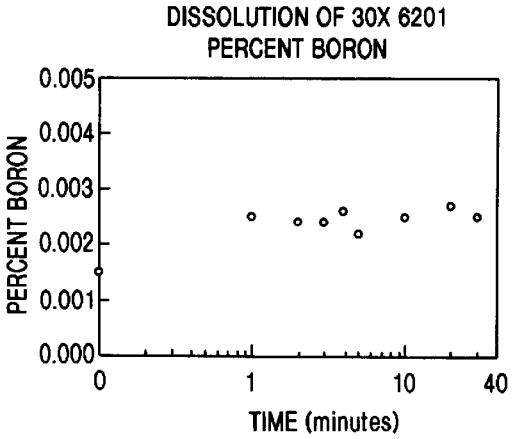
Figure 3B:
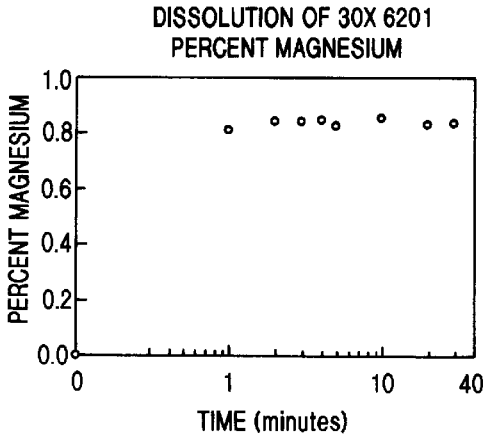

A micrograph prepared by the SEM identified three phases. See FIG. 2. An analysis of the chemical composition of the phases by EDX showed one phase to be an intermetallic phase containing Mg (66.4%), Si (29.3%), and Al 4.3%). The second and third phases were predominately aluminum. The second phase contained 2.0% Mg, 2.6% Si, and 95.3% Al. The third phase contained 2.9% Mg, 13.1% Si, and 84.0% Al. EDX x-ray maps confirmed the relative concentration and location of Al, Si, and Mg in the microstructure. When set for the particular element sought, the brighter images, which show the higher concentration of the indicated element, were found in the phase areas indicated above. See FIG. 3. The micrographs and the phase chemistries showed that the phases were relatively fine and dispersed and that they closely resembled the phases found in the dilute alloy.

Figure 4:
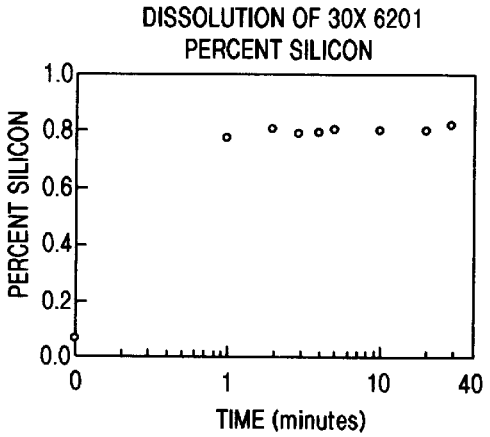
FIG. 4 shows the dissolution rates of the boron, magnesium, and silicon alloying elements in the 30X 6201 master alloy hardener, indicating complete suspension within one minute.
Figure 5:
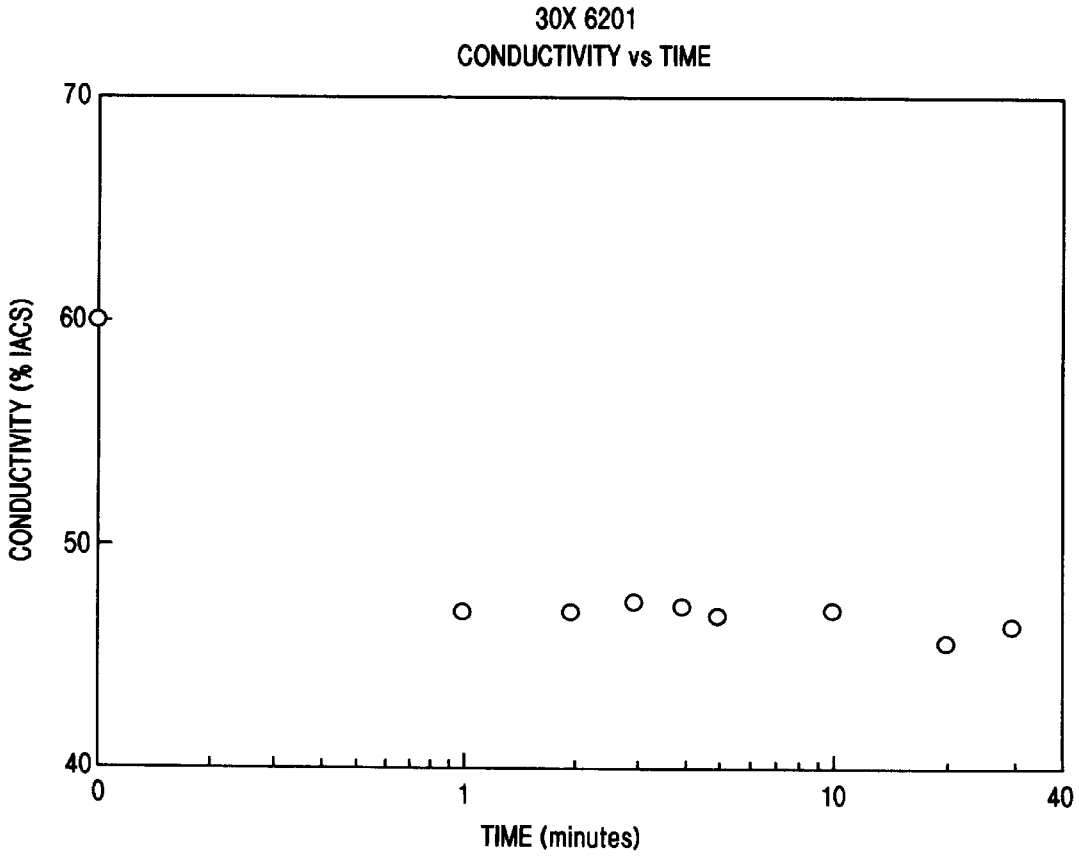
FIG. 5 shows the conductivity versus time of commercially pure P1020 aluminum to which the 30X 6201 master alloy hardener has been added. It indicates complete dissolution within one minute.

In the dissolution study, the melt comprised 3.3% hardener and 96.7% P1020 aluminum at 725° C. The dissolution rates for B, Mg, and Si were determined by determining the weight percent of each element in the base alloy under preparation as a function of time. Each element in the master alloy hardener was dispersed within the melt within one minute as evidenced by the increase in B from a residual from 0.0015% to 0.0025%, Mg from 0.0% to 0.8%, and Si from less than 0.1% to 0.8%. See FIG. 4. The electrical conductivity measurements of the melt were determined and plotted over time. The results showed that minimum electrical conductivity was obtained after one minute, with conductivity going from about 60% IACS to about 47% IACS, indicating that the elements added by the hardener were in solution. See FIG. 5.

4X 3XX(SPECIAL) Master Alloy Hardener

A 4X 3XX(SPECIAL) master alloy hardener was prepared with the following composition: 6.75% Mg, 39.3% Si, 19.1% Cu, 0.008% Sr, and 34.8% Al. Diluting it with three parts of commercially pure aluminum produced a base alloy with the following composition: 1.75% Mg, 10.56% Si, 5.58% Cu, 0.002% Sr, and 82.10% Al.

The SEM showed four phases. The first had a composition of 0.8% Mg, 96.6% Si, 0.7% Cu, and 2.0% Al. The second had a composition of 30.4% Mg, 40.1% Si, 12.6% Cu, and 16.9% Al. The third had a composition of 1.5% Mg, 7.8% Si, 37.0% Cu, and 53.7% Al. The fourth had a composition of 2.0% Mg, 2.9% Si, 1.6% Cu, and 93.5% Al.

The dissolution study was performed with a melt comprising 25% of the hardener and the balance P1020 aluminum at 755° C. Each element was dispersed within the melt within three minutes, as evidenced by an increase in Si from 0.0% to 10.56%, Cu from 0.0% to 5.58%, and Mg from 0.0% to 1.75%.

Electrical conductivity stability analysis also indicated complete dissolution within three minutes. Conductivity went from approximately 60% IACS to approximately 25% IACS within that time period.

4.5X 350 Master Alloy Hardener

This master alloy hardener was prepared with the following composition: 21.7% Cu, 1.8% Mn, 1.1% Ti, 1.3% Co, 8.6% Ni, 1.1 Zr, and 64.4% Al. Diluting it with commercially pure aluminums produced a 350 base alloy with the following composition: 4.8% Cu, 92.1% Al, 0.4% Mn, 0.2% Ti, 0.3% Co, 1.9% Ni and 0.2% Zr.

The SEM identified six phases. The first has a phase chemistry of 2.3% Cu, 0.8% Mn, 1.1% Ti, 0.6% Co, 0.7% Ni, 0.6% Zr, and 93.9% Al. The second had the following composition: 2.4% Cu, 63.6% Al, 1.3% Mn, 20.9% Ti, 1.0% Co, 1.3% Ni, and 9.5% Zr. The third of the following composition: 19.7% Cu, 44.0% Al, 2.2% Mn, 2.6% Ti, 4.2 Co, 25.2% Ni, and 2.0 Zr. The fourth had the following composition: 8.6% Cu, 63.3% Al, 16.7% Mn, 1.8% Ti, 2.5% Co, 5.6% Ni, and 1.4% Zr. The fifth had the following composition: 3.1% Cu, 72.0% Al, 2.3% Mn, 1.7% Ti, 9.1% Co, 10.5% Ni, and 1.3% Zr. The sixth had the following composition: 32.4% Cu, 55.1% Al, 2.5% Mn, 2.4% Ti, 2.7% Co, 2.8% Ni, and 2.0 Zr.

In the dissolution study, the melt comprised 22.2% of the hardener and the balance P1020 aluminum at 725° C. Chemical analysis of the Ni, Mn, Cu, and Ti indicated complete suspension within one minute with these elements going to their final diluted concentrations.

The electrical conductivity stability study also indicated complete dissolution within one minute. Conductivity went from approximately 61% IACS to approximately 30% IACS.

7X A356 Master Alloy Hardener

A 7X A356 master alloy hardener was prepared with the following composition: 3.26% Mg, 47.7% Si, 47.5% Al, and 1.45% Ti. Upon dissolution in a commercially pure aluminum, the final A356 base alloy contained 0.46% Mg, 6.81% Si, 0.21% Ti, and the balance aluminum.

The SEM identified six phases in the hardener. The first contained 60.4% Mg, 34.7% Si, 3.3% Al, 0.7% Fe, and 0.9% Ti. (The Fe was present in the phases as an impurity.) The second phase contained 0.6% Mg, 96.3% Si, 2.4% Al, 0.3% Fe, and 0.3% Ti. The third phase contained 1.2% Mg, 58.4% Si, 10.0% Al, 0.8% Fe, and 29.5% Ti. The four phase contained 4.7% Mg, 12.9% Si, 81.1% Al, 0.6% Fe, and 0.8% Ti. The fifth phase contained 1.8% Mg, 7.6% Si, 89.5% Al, 0.4% Fe, and 0.7% Ti. The sixth phase contained 14.9% Mg, 24.7% Si, 54.9% Al, 4.4% Fe, and 1.1% Ti.

In the dissolution study conducted at 725° C., the melt comprised 14% hardener and the balance P1020 aluminum. Chemical analysis of Sr, Ti, Mg, and Si indicated a complete suspension within twenty minutes. The electrical conductivity stability analysis indicated complete dissolution within 30 minutes with conductivity going from 61% IACS to approximately 33% IACS.

16.5X 380/380 Master Alloy Hardener

A 16.5X 380 master alloy hardener was prepared with the following composition: 33.4% Si, 32.6% Cu, and 34.0% Al. It was diluted with 380 alloy. Prior to solutionizing, the 380 alloy contained 8.9% Si and 3.49% Cu. After solutionizing, the final alloy contained 10.62% Si and 5.40% Cu. Therefore, the contribution of the master alloy to the 380 alloy diluent was 1.7% Si, 1.9% Cu, and 96.4% Al.

The SEM identified four phases. The first contained 97.2% Si, 0.4% Cu, 2.0% Al, and 0.4% Fe. (The Fe was present in the phases as an impurity.) The second contained 2.6% Si, 1.0% Cu, 95.9% Al, and 0.5% Fe. The third contained 7.4% Si, 18.3% Cu, 72.5% Al, and 1.8% Fe. The fourth contained 6.5% Si, 12.6% Cu, 72.6% Al, and 8.4% Fe.

In the dissolution study conducted at 725° C., the melt comprised 6% hardener and the balance 380 alloy. Chemical analysis of the Si and Cu indicated complete suspension within five minutes. The electrical conductivity stability analysis indicated complete dissolution within five minutes with conductivity going from approximately 24% IACS to approximately 23% IACS.

5X 380.1 Master Alloy Hardener

A 5X 380.1 master alloy was prepared that contained 42.5% Si and 18.7% Cu. It also contained Ti and Sr, but no composition figures were available due to inaccurate sampling. The diluted alloy contained 9.79% Si, 4.43% Cu, 0.013% Ti, and 0.017% Sr.

The SEM showed four phases. The first contained 93.0% Si, 1.0% Cu, 1.0% Ti, and 5.1% Al. The second contained 29.6% Si, 1.8% Cu, 1.7% Ti, and 66.9% Al. The third contained 4.6% Si, 34.0% Cu, 2.2% Ti, and 59.2% Al. The fourth contained 9.0% Si, 9.7% Cu, 2.1% Ti, and 79.1% Al.

The dissolution study was conducted at 725° C., with 20% hardener and 80% P1020 aluminum. Complete suspension occurred within 8 minutes. The electrical conductivity stability study also indicated complete dissolution within 8 minutes with conductivity going from approximately 65% IACS to approximately 35% IACS.

4X 383.2 Master Alloy Hardener

A 4X 383.2 master alloy was prepared that contained 42.3% Si, 3.3% Fe, and 10.4% Cu. It also contained Ti and Sr. However, these concentrations were not reported. The diluted alloy contained 12.76% Si, 1.15% Fe, and 2.95% Cu. The Ti was slightly more than 0.01%. The Sr was thought to be 0.005%, but this number was not deemed to be reliable due to sampling technique.

The SEM showed four phases. The first contained 93.5% Si, 0.6% Fe, 0.8% Cu, 0.6% Ti, and 4.4% Al. The second contained 1.9% Si, 0.6% Fe, 1.7% Cu, 0.7% Ti, and 95.0% Al. The third contained 4.6% Si, 2.2% Fe, 28.8% Cu, 2.0% Ti, and 62.5% Al. The fourth phase contained 18.4% Si, 19.6% Fe, 1.2% Cu, 1.4% Ti, and 59.9% Al.

The dissolution study was conducted at 725° C. using 25% hardener and 75% P1020 aluminum. Chemical analysis indicated complete suspension of the alloying elements within ten minutes. The electrical conductivity stability study indicated complete dissolution within 8 minutes with conductivity going from approximately 60% IACS to approximately 28% IACS.

10X 2124 Master Alloy Hardener

This alloy was prepared with a composition of 15.0% Mg, 40.2% Cu, 6.75% Mn, and less than 0.10 Si. The diluted base alloy contained 1.66% Mg, 4.10% Cu, and 0.73% Mn.

The SEM showed six phases. The first contained 9.8% Mg, 0.9% Si, 0.6% Cu, 88.2% Al, and 0.6% Mn. The second contained 49.8% Mg, 44.9% Si, 0.7% Cu, 3.8% Al, and 0.7% Mn. The third contained 20.6% Mg, 2.6% Si, 14.0% Cu, 61.0% Al, and 1.8% Mn. The fourth contained 5.5% Mg, 1.2% Si, 3.0% Cu, 79.5% Al, and 10.8% Mn. The fifth contained 33.3% Mg, 1.5% Si, 6.3% Cu, 57.7% Al, and 1.1% Mn. The sixth contained 28.3% Mg, 3.3% Si, 21.6% Cu, 43.9% Al, and 2.8% Mn.

In the dissolution study conducted at 725° C., chemical analysis of Mg, Cu, and Mn indicated a complete suspension within five minutes. The study was conducted with 10% hardener, balance P1020 aluminum. The electrical conductivity stability study indicated a complete dissolution within two minutes with conductivity going from approximately 61% IACS to approximately 28% IACS.

33X 3003 Master Alloy Hardener

This hardener contained the following alloying elements: 4.6% Cu, 37.8% Mn, and 22.4% Fe. It was used to prepare a 3003 base alloy that contained 0.15% Cu, 1.38% Mn, and 0.94% Fe. This last number did not allow for the Fe content in the P1020 aluminum diluent.

The SEM showed five phases for the master alloy hardener. The first contained 4.0% Cu, 44.5% Mn, 29.4% Fe and 22.1% Al. The second contained 3.6% Cu, 43.2% Mn, 29.3% Fe and 23.6% Al. The third contained 3.6% Cu, 43.7% Mn, 29.4% Fe and 23.3% Al. The fourth contained 6.3% Cu, 51.0% Mn, 40.2% Fe and 2.5% Al. The fifth contained 4.0% Cu, 43.3% Mn, 30.1% Fe and 22.6% Al.

The dissolution study was conducted with 3% hardener and 97% P1020 aluminum at 725° C. Chemical analysis of the alloying elements indicated a complete suspension within twenty minutes. The electrical conductivity stability study indicated complete dissolution within eight minutes with conductivity going from approximately 61% IACS to approximately 33% IACS.

40X 3003 Master Alloy Hardener

This hardener contained the following alloying elements: 40% Mn, 11.75% Fe, 5.1% Cu, and 8.12% Si. It was used to prepare 3003 base alloy, which contained 1.11% Mn, 0.48% Fe, 0.14% Cu, and 0.26% Si. The target chemistries for the Fe and the Si in the final base alloy were somewhat different than expected because of incorrect assumptions of the amounts of these elements in the diluting commercial aluminum.

The SEM identified three phases in the hardener. The first contained 47.9% Mn, 19.9% Fe, 3.9% Cu, 6.6% Si, and 21.8% Al. The second phase contained 22.4% Mn, 8.2% Fe, 49.2% Cu, 1.6% Si, and 18.6% Al. The third phase contained 48.5% Mn, 19.6% Fe, 3.8% Cu, 6.2% Si, and 21.8% Al.

The dissolution study was conducted with 2.5% hardener and 97.5% P1020 aluminum at 788° C. Chemical analysis of the alloying elements indicated complete suspension within ten minutes. The electrical conductivity stability study indicated complete dissolution within nine minutes for the splatter hardener, with conductivity going from approximately 61% IACS to approximately 32% IACS.

8X 5182 Master Alloy Hardener

This master alloy contained 1.82% Fe, 1.96% Mn, 38.9% Mg, and 0.11% Ti. After dilution with P1020 aluminum, the 5182 base alloy contained 0.36% Fe, 0.24% Mn, 4.91% Mg, and 0.01% Ti.

The SEM identified five phases in the hardener. The first contained 2.2% Fe, 7.2% Mn, 22.6% Mg, 2.1% Ti, and 65.8% Al. The second contained 10.6% Fe, 12.8% Mn, 5.3% Mg, 1.5% Ti, and 69.8% Al. The third contained 4.1% Fe, 6.3% Mn, 18.1% Mg, 10.2% Ti, and 61.2% Al. The fourth contained 0.9% Fe, 0.9% Mn, 54.9% Mg, 0.9% Ti, and 42.4% Al. The fifth contained 1.1% Fe, 1.4% Mn, 44.8% Mg, 0.8% Ti, and 51.9% Al.

The dissolution study was conducted with 12.5% hardener and 87.5% P1020 aluminum at 725° C. Chemical analysis of the concentrations of the alloying elements over time indicated complete suspension of the elements within two minutes. The electrical conductivity stability study indicated complete dissolution within one minute with conductivity going from approximately 61% IACS to approximately 28% IACS.

30X 6061 Master Alloy Hardener

This hardener contained the following alloying elements: 27.6% Mg, 19.0% Si, 7.23% Cu, 45.37% Al, and 0.8% Cr. It was used to prepare a 6061 base alloy that contained 1.13% Mg, 0.66% Si, 0.26% Cu, 97.93% Al, and 0.02% Cr.

The SEM showed four phases for the master alloy hardener. The first contained 56.5% Mg, 38.7% Si, 0.9% Cu, 3.1% Al, and 0.8% Cr. The second contained 8.6% Mg, 2.4% Si, 3.9% Cu, 73.3% Al, and 11.9% Cr. The third contained 3.5% Mg, 3.5% Si, 32.9% Cu, 58.0% Al, and 2.1% Cr. The fourth contained 2.8% Mg, 1.3% Si, 1.5% Cu, 93.6% Al, and 0.8% Cr.

The dissolution study was conducted with 3.3% hardener and the balance P1020 aluminum at 725° C. Chemical analysis of the alloying elements indicated a complete suspension within eight minutes. The electrical conductivity stability study indicated complete dissolution within eight minutes with conductivity going from approximately 61% IACS to approximately 45% IACS.

30X 6063 Master Alloy Hardener

The alloy 6063 contains the following elements: 0.68% Mg, 0.55% Si, and 98.7% Al. Therefore, the target composition of the 30X 6063 master alloy was 20.5% Mg, 16.4% Si, and 63.1% Al. The actual composition for this hardener was 20.6% Mg, 16.4% Si, and 63.0% Al. When diluted with commercial aluminum to form 6063 alloy, the actual chemical composition of the base alloy was 0.72% Mg, 0.81% Si, and 98.41% Al.

The SEM showed four phases for the master alloy hardener. The first contained 39.7% Mg, 55.3% Si, 4.3% Al, and 0.6% Fe. (The iron was present as an impurity in all phases.) The second contained 50.2% Mg, 35.0% Si, 14.3% Al, and 0.5% Fe. The third contained 2.2% Mg, 1.8% Si, 95.5% Al, and 0.5% Fe. The fourth contained 11.0% Mg, 23.4% Si, 62.6% Al, and 3.0% Fe.

The dissolution study was conducted with 3.3% hardener and 96.7% P1020 aluminum at 725° C. Chemical analysis of the alloying elements indicated a complete suspension within one minute. The electrical conductivity stability study indicated complete dissolution within one minute with conductivity going from approximately 61% IACS to approximately 48% IACS.

7X 7150 Master Alloy Hardener

This hardener contained the following alloying elements: 14.2% Cu, 15.9% Mg, 44.6% Zn, and 0.82% Zr. It was used to prepare a 7150 base alloy that contained 2.08% Cu, 2.10% Mg, 6.04% Zn, and 0.19% Zr.

The SEM showed three phases for the hardener. The first contained 4.3% Cu, 2.0% Mg, 19.7% Zn, 35.6% Zr, and 38.4% Al. The second contained 4.6% Cu, 3.5% Mg, 13.7% Zn, 0.9% Zr, and 77.3% Al. The third contained 30.2% Cu, 8.8% Mg, 48.9% Zn, 2.2% Zr, and 10.0% Al.

The dissolution study was conducted with 14.2% hardener and 85.8% P1020 aluminum at 725° C. Chemical analysis of the alloying elements indicated complete suspension within three minutes. The electrical conductivity stability study indicated complete dissolution within one minute with conductivity going from approximately 64% IACS to approximately 33% IACS.

10X 7475 Master Alloy Hardener

This hardener contained the following alloying elements: 51.5% Zn, 21.3% Mg, 13.7% Cu, and 2.3% Cr. It was used to prepare a 7475 base alloy that contained 5.2% Zn, 2.0% Mg, 1.5% Cu, and 0.2% Cr.

The SEM showed four phases for the hardener. The first contained 5.1% Al, 12.1% Zn, 75.9% Mg, 4.2% Cu, and 2.8% Cr. The second contained 18.8% Al, 38.6% Zn, 26.3% Mg, 11.3% Cu, and 5.1% Cr. The third contained 13.2% Al, 38.7% Zn, 18.6% Mg, 23.9% Cu, and 5.6% Cr. The fourth contained 51.0% Al, 5.3% Zn, 2.6% Mg, 3.9% Cu, and 37.2% Cr.

The dissolution study was conducted with 10% hardener and 90% P1020 aluminum at 725° C. Chemical analysis of the alloying elements indicated a complete suspension within one minute. The electrical conductivity stability study indicated complete dissolution within one minute with conductivity going from approximately 60% IACS to approximately 30% IACS.

66X 8111 Master Alloy Hardener

This hardener contained Si and Fe as alloying elements. The actual amounts were not available. It was used to prepare a 8111 base alloy that contained 0.63% Si and 0.87% Fe.

The SEM showed four phases for this hardener. The first contained 31.7% Si, 25.3% Fe, and 43.1% Al. The second contained 29.2% Si, 37.2% Fe, and 33.6% Al. The third contained 35.8% Si, 45.7% Fe, and 18.5% Al. The fourth contained 96.9% Si, 1.1% Fe, and 2.0% Al.

The dissolution study was conducted with 1.5% hardener and 98.5% P1020 aluminum at 843° C. It was conducted at both 788° C. and 843° C. Chemical analysis of the alloying elements in the melt indicated a complete suspension within 30 minutes. The study was done for both ingot and splatter form of the hardener. The electrical conductivity stability study at both 788° C. and 843° C. indicated complete dissolution within 20 minutes with conductivity going from approximately 61% IACS to approximately 53% IACS.

It will be apparent to those skilled in the art that various modifications and variations can be made to the products and processes of the present invention. Thus, it is intended that the present invention covers such modifications and variations, provided they come within the scope of the appended claims and their equivalents.

TABLE 1

Chemical Composition Limits of Wrought Aluminum Alloys1/ 2/

| AA DESIGNATION | SILICON | IRON | COPPER | MANGANESE | MAGNESIUM | CHROMIUM | NICKEL | ZINC | TITANIUM | OTHERS22/ Each20/ | OTHERS22/ Total3/ | ALUMINUM Min.4/ |
|---|---|---|---|---|---|---|---|---|---|---|---|---|
| 1050 | 0.25 | 0.30 | 0.05 | 0.05 | 0.05 | — | — | 0.05 | 0.03 | 0.039/ | — | 99.50 |
| 1060 | 0.25 | 0.35 | 0.05 | 0.03 | 0.03 | — | — | 0.05 | 0.03 | 0.039/ | — | 99.60 |
| 1100 | 0.95 Si + Fe | | 0.05–0.20 | 0.05 | — | — | — | 0.10 | — | 0.0516/ | 0.15 | 99.00 |
| 11456/ | 0.55 Si + Fe | | 0.05 | 0.05 | 0.05 | — | — | 0.05 | 0.03 | 0.039/ | — | 99.45 |
| 11757/ | 0.15 Si + Fe | | 0.10 | 0.02 | 0.02 | — | — | 0.04 | 0.02 | 0.0219/ | — | 99.75 |
| 1200 | 1.00 Si + Fe | | 0.05 | 0.05 | — | — | — | 0.10 | 0.05 | 0.05 | 0.15 | 99.00 |
| 12307/ | 0.70 Si + Fe | | 0.10 | 0.05 | 0.05 | — | — | 0.10 | 0.03 | 0.039/ | — | 99.30 |
| 1235 | 0.65 Si + Fe | | 0.05 | 0.05 | 0.05 | — | — | 0.10 | 0.06 | 0.039/ | — | 99.35 |
| 1345 | 0.03 | 0.40 | 0.10 | 0.05 | 0.05 | — | — | 0.05 | 0.03 | 0.039/ | — | 99.45 |
| 13506/ | 0.10 | 0.40 | 0.05 | 0.01 | — | 0.01 | — | 0.05 | — | 0.0313/ | 0.10 | 99.50 |
| 2011 | 0.40 | 0.7 | 5.0–6.0 | — | — | — | — | 0.30 | — | 0.0510/ | 0.15 | Remainder |
| 2014 | 0.05–1.2 | 0.7 | 3.9–5.0 | 0.40–1.2 | 0.20–0.8 | 0.10 | — | 0.25 | 0.15 | 0.05 | 0.15 | Remainder |
| 2017 | 0.20–0.8 | 0.7 | 3.5–4.5 | 0.40–1.0 | 0.40–0.8 | 0.10 | — | 0.25 | 0.15 | 0.05 | 0.15 | Remainder |
| 2018 | 0.9 | 1.0 | 3.5–4.5 | 0.20 | 0.45–0.9 | 0.10 | 1.7–2.3 | 0.25 | — | 0.05 | 0.15 | Remainder |
| 2024 | 0.50 | 0.50 | 3.8–4.9 | 0.30–0.9 | 1.2–1.8 | 0.10 | — | 0.25 | 0.15 | 0.05 | 0.15 | Remainder |
| 2025 | 0.50–1.2 | 1.0 | 3.9–5.0 | 0.40–1.2 | 0.05 | 0.10 | — | 0.25 | 0.15 | 0.05 | 0.15 | Remainder |
| 2036 | 0.50 | 0.50 | 2.2–3.0 | 0.10–0.40 | 0.30–0.6 | 0.10 | — | 0.25 | 0.15 | 0.05 | 0.15 | Remainder |
| 2117 | 0.8 | 0.7 | 2.2–3.0 | 0.20 | 0.20–0.50 | 0.10 | — | 0.25 | — | 0.05 | 0.15 | Remainder |
| 2124 | 0.20 | 0.30 | 3.8–4.9 | 0.30–0.9 | 1.2–1.8 | 0.10 | — | 0.25 | 0.15 | 0.05 | 0.15 | Remainder |
| 2218 | 0.9 | 1.0 | 3.5–4.5 | 0.20 | 1.2–1.8 | 0.10 | 1.7–2.3 | 0.25 | — | 0.05 | 0.15 | Remainder |
| 2219 | 0.20 | 0.30 | 5.8–6.8 | 0.20–0.40 | 0.02 | — | — | 0.10 | 0.02–0.10 | 0.0518/ | 0.15 | Remainder |
| 2319 | 0.20 | 0.30 | 5.8–6.8 | 0.20–0.40 | 0.02 | — | — | 0.10 | 0.10–0.20 | 0.0518/ | 0.15 | Remainder |
| 2618 | 0.10–0.25 | 0.9–1.3 | 1.9–2.7 | — | 1.3–1.8 | — | 0.9–1.2 | 0.10 | 0.04–0.10 | 0.05 | 0.15 | Remainder |
| 3003 | 0.6 | 0.7 | 0.05–0.20 | 1.0–1.5 | — | — | — | 0.10 | — | 0.05 | 0.15 | Remainder |
| 3004 | 0.30 | 0.7 | 0.25 | 1.0–3.5 | 0.8–1.3 | — | — | 0.25 | — | 0.05 | 0.15 | Remainder |
| 3005 | 0.6 | 0.7 | 0.30 | 1.0–3.5 | 0.20–0.6 | 0.10 | — | 0.25 | 0.10 | 0.05 | 0.15 | Remainder |
| 3105 | 0.6 | 0.7 | 0.30 | 0.30–0.8 | 0.20–0.8 | 0.20 | — | 0.40 | 0.10 | 0.05 | 0.15 | Remainder |
| 4032 | 11.0–13.5 | 1.0 | 0.50–1.3 | — | 0.6–1.3 | 0.10 | 0.50–1.3 | 0.25 | — | 0.05 | 0.15 | Remainder |
| 4043 | 4.5–6.0 | 0.8 | 0.30 | 0.05 | 0.05 | — | — | 0.10 | 0.20 | 0.0516/ | 0.15 | Remainder |
| 40411/ | 9.0–11.0 | 0.8 | 0.30 | 0.05 | 0.05 | — | — | 0.10 | 0.20 | 0.05 | 0.15 | Remainder |
| 40711/ | 11.0–13.0 | 0.8 | 0.30 | 0.15 | 0.10 | — | — | 0.20 | — | 0.0516/ | 0.15 | Remainder |
| 41411/ | 9.3–10.7 | 0.8 | 3.3–4.7 | 0.15 | 0.15 | 0.15 | — | 0.20 | — | 0.0516/ | 0.15 | Remainder |
| 43411/ | 6.9–8.2 | 0.8 | 0.25 | 0.10 | — | — | — | 0.20 | — | 0.05 | 0.15 | Remainder |
| 5005 | 0.30 | 0.7 | 0.20 | 0.20 | 0.50–1.1 | 0.10 | — | 0.25 | — | 0.05 | 0.15 | Remainder |
| 5050 | 0.40 | 0.7 | 0.20 | 0.10 | 1.1–1.8 | 0.10 | — | 0.25 | — | 0.05 | 0.15 | Remainder |
| 5052 | 0.25 | 0.40 | 0.10 | 0.10 | 2.2–2.8 | 0.15–0.35 | — | 0.10 | — | 0.05 | 0.15 | Remainder |
| 5056 | 0.30 | 0.40 | 0.10 | 0.05–0.20 | 4.5–5.8 | 0.05–0.20 | — | 0.10 | — | 0.05 | 0.15 | Remainder |
| 5083 | 0.40 | 0.40 | 0.10 | 0.40–1.0 | 4.0–4.9 | 0.05–0.25 | — | 0.25 | 0.15 | 0.05 | 0.15 | Remainder |
| 5086 | 0.40 | 0.50 | 0.10 | 0.20–0.7 | 3.5–4.5 | 0.05–0.25 | — | 0.25 | 0.15 | 0.05 | 0.15 | Remainder |
| 5154 | 0.25 | 0.40 | 0.10 | 0.10 | 3.1–3.9 | 0.15–0.35 | — | 0.20 | 0.20 | 0.05 | 0.15 | Remainder |
| 5183 | 0.40 | 0.40 | 0.10 | 0.50–1.0 | 4.3–5.2 | 0.05–0.25 | — | 0.25 | 0.15 | 0.0516/ | 0.15 | Remainder |
| 5252 | 0.08 | 0.10 | 0.10 | 0.10 | 2.2–2.8 | — | — | 0.05 | — | 0.039/ | 0.10 | Remainder |
| 5254 | 0.45 Si + Fe | | 0.05 | 0.01 | 3.1–3.9 | 0.15–0.35 | — | 0.20 | 0.05 | 0.05 | 0.15 | Remainder |
| 5356 | 0.25 | 0.40 | 0.10 | 0.05–0.20 | 4.5–5.5 | 0.05–0.20 | — | 0.10 | 0.06–0.20 | 0.0516/ | 0.15 | Remainder |
| 5454 | 0.25 | 0.40 | 0.10 | 0.50–1.0 | 2.4–3.0 | 0.05–0.20 | — | 0.25 | 0.20 | 0.05 | 0.15 | Remainder |
| 5456 | 0.25 | 0.40 | 0.10 | 0.50–1.0 | 4.7–5.5 | 0.05–0.20 | — | 0.25 | 0.20 | 0.05 | 0.15 | Remainder |
| 5457 | 0.08 | 0.10 | 0.20 | 0.15–0.45 | 0.8–1.2 | — | — | 0.05 | — | 0.039/ | 0.10 | Remainder |
| 5554 | 0.25 | 0.40 | 0.10 | 0.50–1.0 | 2.4–3.0 | 0.05–0.20 | — | 0.25 | 0.05–0.20 | 0.0516/ | 0.15 | Remainder |
| 5556 | 0.25 | 0.40 | 0.10 | 0.50–1.0 | 4.7–5.5 | 0.05–0.20 | — | 0.25 | 0.05–0.20 | 0.0516/ | 0.15 | Remainder |
| 5652 | 0.40 Si + Fe | | 0.04 | 0.01 | 2.2–2.8 | 0.15–0.35 | — | 0.10 | — | 0.05 | 0.15 | Remainder |
| 5654 | 0.45 Si + Fe | | 0.05 | 0.01 | 3.1–3.9 | 0.15–0.35 | — | 0.20 | 0.05–0.15 | 0.0516/ | 0.15 | Remainder |
| 5657 | 0.08 | 0.10 | 0.10 | 0.03 | 0.6–1.0 | — | — | 0.05 | — | 0.0219/ | 0.05 | Remainder |
| 60037/ | 0.35–1.0 | 0.6 | 0.10 | 0.8 | 0.8–1.5 | 0.35 | — | 0.20 | 0.10 | 0.05 | 0.15 | Remainder |
| 6005 | 0.6–0.9 | 0.35 | 0.10 | 0.10 | 0.40–0.6 | 0.10 | — | 0.10 | 0.10 | 0.05 | 0.15 | Remainder |
| 6053 | 15/ | 0.35 | 0.10 | — | 1.1–1.4 | 0.15–0.35 | — | 0.10 | — | 0.05 | 0.15 | Remainder |
| 6061 | 0.40–0.8 | 0.7 | 0.15–0.40 | 0.15 | 0.8–1.2 | 0.04–0.35 | — | 0.25 | 0.15 | 0.05 | 0.15 | Remainder |
| 6063 | 0.20–0.6 | 0.35 | 0.10 | 0.10 | 0.45–0.9 | 0.10 | — | 0.10 | 0.10 | 0.05 | 0.15 | Remainder |
| 6066 | 0.9–1.8 | 0.50 | 0.7–1.2 | 0.6–1.1 | 0.8–1.4 | 0.40 | — | 0.25 | 0.20 | 0.05 | 0.15 | Remainder |
| 6070 | 1.0–1.7 | 0.50 | 0.15–0.40 | 0.40–1.0 | 0.50–1.2 | 0.10 | — | 0.25 | 0.15 | 0.05 | 0.15 | Remainder |
| 61012/ | 0.30–0.7 | 0.50 | 0.10 | 0.03 | 0.35–0.8 | 0.03 | — | 0.10 | — | 0.0317/ | 0.10 | Remainder |
| 6105 | 0.6–1.0 | 0.35 | 0.10 | 0.10 | 0.45–0.8 | 0.10 | — | 0.10 | 0.10 | 0.05 | 0.15 | Remainder |
| 6151 | 0.6–1.2 | 1.0 | 0.35 | 0.20 | 0.45–0.8 | 0.15–0.35 | — | 0.25 | 0.15 | 0.05 | 0.15 | Remainder |
| 6162 | 0.40–0.8 | 0.50 | 0.20 | 0.10 | 0.7–1.1 | 0.10 | — | 0.25 | 0.10 | 0.05 | 0.15 | Remainder |
| 6201 | 0.50–0.9 | 0.50 | 0.10 | 0.03 | 0.6–0.9 | 0.03 | — | 0.10 | — | 0.0317/ | 0.10 | Remainder |
| 62537/ | 15/ | 0.50 | 0.10 | — | 1.0–1.5 | 0.04–0.35 | — | 1.6–2.4 | — | 0.05 | 0.15 | Remainder |
| 6282 | 0.40–0.8 | 0.7 | 0.15–0.40 | 0.15 | 0.8–1.2 | 0.04–0.14 | — | 0.25 | 0.15 | 0.055/ | 0.15 | Remainder |
| 6351 | 0.7–1.3 | 0.50 | 0.10 | 0.40–0.8 | 0.40–0.8 | — | — | 0.20 | 0.20 | 0.05 | 0.15 | Remainder |
| 6463 | 0.20–0.6 | 0.15 | 0.20 | 0.05 | 0.45–0.9 | — | — | 0.05 | — | 0.05 | 0.15 | Remainder |
| 6951 | 0.20–0.50 | 0.8 | 0.15–0.40 | 0.10 | 0.40–0.8 | — | — | 0.20 | — | 0.05 | 0.15 | Remainder |

TABLE 1-continued

Chemical Composition Limits of Wrought Aluminum Alloys1/ 2/

| AA DESIGNATION | SILICON | IRON | COPPER | MANGANESE | MAGNESIUM | CHROMIUM | NICKEL | ZINC | TITANIUM | OTHERS22/ Each20/ | OTHERS22/ Total3/ | ALUMINUM Min.4/ |
|---|---|---|---|---|---|---|---|---|---|---|---|---|
| 7005 | 0.35 | 0.40 | 0.10 | 0.20–0.7 | 1.0–1.8 | 0.06–0.20 | — | 4.0–5.0 | 0.01–0.06 | 0.0514/ | 0.15 | Remainder |
| 70087/ | 0.10 | 0.10 | 0.05 | 0.05 | 0.7–1.4 | 0.12–0.25 | — | 4.5–5.5 | 0.05 | 0.05 | 0.10 | Remainder |
| 7049 | 0.25 | 0.35 | 1.2–1.9 | 0.20 | 2.0–2.9 | 0.10–0.22 | — | 7.2–8.2 | 0.10 | 0.05 | 0.15 | Remainder |
| 7050 | 0.12 | 0.15 | 2.0–2.6 | 0.10 | 1.9–2.6 | 0.04 | — | 5.7–6.7 | 0.06 | 0.0521/ | 0.15 | Remainder |
| 70727/ | 0.7 Si + Fe | | 0.10 | 0.10 | 0.10 | — | — | 0.8–1.3 | — | 0.05 | 0.15 | Remainder |
| 7075 | 0.40 | 0.50 | 1.2–2.0 | 0.30 | 2.1–2.9 | 0.18–0.28 | — | 5.1–6.1 | 0.20 | 0.05 | 0.15 | Remainder |
| 7175 | 0.15 | 0.20 | 1.2–2.0 | 0.10 | 2.1–2.9 | 0.18–0.28 | — | 5.1–6.1 | 0.10 | 0.05 | 0.15 | Remainder |
| 7176 | 0.40 | 0.50 | 1.6–2.4 | 0.30 | 2.4–3.1 | 0.18–0.28 | — | 6.3–7.3 | 0.20 | 0.05 | 0.15 | Remainder |
| 7475 | 0.10 | 0.12 | 1.2–1.9 | 0.06 | 1.9–2.6 | 0.18–0.25 | — | 5.2–6.2 | 0.06 | 0.05 | 0.15 | Remainder |
| 8017 | 0.10 | 0.55–0.8 | 0.10–0.20 | — | 0.01–0.05 | — | — | 0.05 | — | 0.0323/ | 0.10 | Remainder |
| 8030 | 0.10 | 0.30–0.8 | 0.15–0.30 | — | 0.05 | — | — | 0.05 | — | 0.0324/ | 0.10 | Remainder |
| 8176 | 0.03–0.15 | 0.40–1.0 | — | — | — | — | — | 0.10 | — | 0.0525/ | 0.15 | Remainder |
| 8177 | 0.10 | 0.25–0.45 | 0.04 | — | 0.04–0.12 | — | — | 0.05 | — | 0.0326/ | 0.10 | Remainder |

1/Composition in percent by weight maximum unless shown as a range or a minimum.
2/Except for "aluminum" and "others", analysis normally is made for elements for which specific limits are shown. For purposes of determining conformance to these limits, an observed value or a calculated value obtained from analysis is rounded off to the nearest unit in the last righthand place of figure used in expressing the specified limit, in accordance with ASTM Recommended Practice E 29.
3/The sum of those "other" metallic elements 0.010 percent or more each, expressed to the second decimal before determining the sum.
4/The aluminum content for unalloyed aluminum not made by a refining process is the difference between 100.00 percent and the sum of all other metallic elements present in amounts of 0.010 percent or more each, expressed to the second decimal before determining the sum.
5/Also contains 0.40–0.7 percent each of lead and bismuth.
6/Electric conductor. Formerly designated EC.
7/Cladding alloy. See Table 6.1.
8/Foil.
9/Vanadium 0.05 percent maximum.
10/Also contains 0.20–0.6 percent of each of lead and bismuth.
11/Brazing alloy.
12/Bus conductor.
13/Vanadium plus titanium 0.02 percent maximum; boron 0.05 percent maxiumum; gallium 0.03 percent maximum.
14/Zirconium 0.08–0.20
15/Silicon 45 to 65 percent of actual magnesium content.
16/Berylium 0.0008 maxiumum for welding electrode and welding rod only.
17/Boron 0.06 percent maximum.
18/Vanadium 0.05–0.15; zirconium 0.10–0.25.
19/Gallium 0.03 percent maximum; vanadium 0.05 percent maximum.
20/In addition to those alloys referencing footnote 16/, a 0.0008 weight percent maximum berylium is applicable to any alloy to be used as welding electorde or welding rod.
21/Zirconium 0.08–0.15.
22/Includes listed elements for which no specific limit is shown.
23/Boron 0.04 percent maximum; lithium 0.003 percent maximum.
24/Boron 0.001–0.04.
25/Gallium 0.03 percent maximum.
26/Boron 0.04 percent maximum.

TABLE 2

CHEMICAL COMPOSITION LIMITS [1][2]
Registered Alloys in the Form of XXX.0 Castings, XXX.1 Ingot and XXX.2 Ingot

| AA No. | Products[5] | Si | Fe | Oi | Mn | Mg | Cr | Ni | Zn | Sn | Ti | OTHERS[31] Each | OTHERS[31] Total[3] | ALUMINUM MIN[4] |
|---|---|---|---|---|---|---|---|---|---|---|---|---|---|---|
| 100.0* | Ingot | 0.15 | 0.6–0.8 | 0.10 | [20] | — | [20] | — | 0.05 | — | [20] | 0.03[20] | 0.10 | 99.00 |
| 130.1* | Ingot | [19] | [19] | 0.10 | [20] | — | [20] | — | 0.05 | — | [20] | 0.03[20] | 0.10 | 99.30 |
| 150.1* | Ingot | [21] | [21] | 0.05 | [20] | — | [20] | — | 0.05 | — | [20] | 0.03[20] | 0.10 | 99.50 |
| 160.1 | Ingot | 0.10[21] | 0.25[21] | — | [20] | — | [20] | — | 0.05 | — | [20] | 0.03[20] | 0.10 | 99.60 |
| 170.1* | Ingot | [22] | [22] | — | [20] | — | [20] | — | 0.05 | — | [20] | 0.03[20] | 0.10 | 99.70 |
| 201.0 | S | 0.10 | 0.15 | 4.0–5.2 | 0.20–0.50 | 0.15–0.55 | — | — | — | — | 0.15–0.35 | 0.05[7] | 0.10 | Remainder |
| 201.2 | Ingot | 0.10 | 0.10 | 4.0–5.2 | 0.20–0.50 | 0.20–0.55 | — | — | — | — | 0.15–0.35 | 0.05[7] | 0.10 | Remainder |
| A201.0 | S | 0.05 | 0.10 | 4.0–5.0 | 0.20–0.40 | 0.15–0.35 | — | — | — | — | 0.15–0.35 | 0.03[7] | 0.10 | Remainder |
| A201.1 | Ingot | 0.05 | 0.07 | 4.0–5.0 | 0.20–0.40 | 0.20–0.35 | — | — | — | — | 0.15–0.35 | 0.03[7] | 0.10 | Remainder |
| *B201.0 | S | 0.05 | 0.05 | 4.5–5.0 | 0.20–0.50 | 0.25–0.35 | — | — | — | — | 0.15–0.35 | 0.05[30] | 0.15 | Remainder |
| 202.0 | S | 0.10 | 0.15 | 4.0–5.2 | 0.20–0.8 | 0.15–0.55 | 0.20–0.6 | — | — | — | 0.15–0.35 | 0.05[7] | 0.10 | Remainder |
| 202.2 | Ingot | 0.10 | 0.10 | 4.0–5.2 | 0.20–0.8 | 0.20–0.55 | 0.20–0.6 | — | — | — | 0.15–0.35 | 0.05[7] | 0.10 | Remainder |
| 203.0 | S | 0.30 | 0.50 | 4.5–5.5 | 0:20–0.30 | 0.10 | — | 1.3–1.1 | 0.10 | — | 0.15–0.25[24] | 0.05[23] | 0.20 | Remainder |
| 203.2 | Ingot | 0.20 | 0.35 | 4.8–5.2 | 0.20–0.30 | 0.10 | — | 1.3–1.7 | 0.10 | — | 0.15–0.25[24] | 0.05[23] | 0.20 | Remainder |
| 204.0 | S&P | 0.20 | 0.35 | 4.2–5.0 | 0.10 | 0.15–0.35 | — | 0.05 | 0.10 | 0.05 | 0.15–0.30 | 0.05 | 0.15 | Remainder |
| 204.2 | Ingot | 0.15 | 0.10–0.20 | 4.2–4.9 | 0.05 | 0.20–0.35 | — | 0.03 | 0.05 | 0.05 | 0.15–0.25 | 0.05 | 0.15 | Remainder |
| 206.0 | S&P | 0.10 | 0.15 | 4.2–5.0 | 0.20–0.50 | 0.15–0.35 | — | 0.05 | 0.10 | 0.05 | 0.15–0.30 | 0.05 | 0.15 | Remainder |
| 206.2 | Ingot | 0.10 | 0.10 | 4.2–5.0 | 0.20–0.50 | 0.20–0.35 | — | 0.03 | 0.05 | 0.05 | 0.15–0.30[25] | 0.05 | 0.15 | Remainder |
| A206.0 | S&P | 0.05 | 0.10 | 4.2–5.0 | 0.20–0.50 | 0.15–0.35 | — | 0.05 | 0.10 | 0.05 | 0.15–0.30 | 0.05 | 0.15 | Remainder |
| A206-2 | Ingot | 0.05 | 0.07 | 4.2–5.0 | 0.20–0.50 | 0.20–0.35 | — | 0.03 | 0.05 | 0.05 | 0.15–0.25 | 0.05 | 0.15 | Remainder |
| 208.0 | S&P | 2.5–3.5 | 1.2 | 3.5–4.5 | 0.50 | 0.10 | — | 0.35 | 1.0 | — | 0.25 | — | 0.50 | Remainder |
| 208.1 | Ingot | 2.5–3.5 | 0.9 | 3.5–4.5 | 0.50 | 0.10 | — | 0.35 | 1.0 | — | 0.25 | — | 0.50 | Remainder |
| 208.2 | Ingot | 2.5–3.5 | 0.8 | 3.5–4.5 | 0.30 | 0.30[03] | — | — | 0.20 | — | 0.20 | — | 0.30 | Remainder |
| 213.0 | S&P | 1.0–3.0 | 1.2 | 6.0–8.0 | 0.6 | 0.10 | — | 0.35 | 2.5 | — | 0.25 | — | 0.50 | Remainder |
| 213.1 | Ingot | 1.0–3.0 | 0.9 | 6.0–8.0 | 0.6 | 0.10 | — | 0.35 | 2.5 | — | 0.25 | — | 0.50 | Remainder |
| 222.0 | S&P | 2.0 | 1.5 | 9.2–10.7 | 0.50 | 0.15–0.35 | — | 0.50 | 0.8 | — | 0.25 | — | 0.35 | Remainder |
| 222.1 | Ingot | 2.0 | 1.2 | 9.2–10.7 | 0.50 | 0.20–0.35 | — | 0.50 | 0.8 | — | 0.25 | — | 0.35 | Remainder |
| 224.0 | S&P | 0.06 | 0.10 | 4.5–5.5 | 0.20–0.50 | — | — | — | — | — | 0.35 | 0.03[13] | 0.10 | Remainder |
| 224.2 | Ingot | 0.02 | 0.04 | 4.5–5.5 | 0.20–0.50 | — | — | — | — | — | 0.25 | 0.03[13] | 0.10 | Remainder |
| 238.0 | P | 3.5–4.5 | 1.5 | 9.0–11.0 | 0.6 | 0.15–0.35 | — | 1.0 | 1.5 | — | 0.25 | — | 0.50 | Remainder |
| 238.1 | Ingot | 3.5–4.5 | 1.2 | 9.0–11.0 | 0.6 | 0.20–0.35 | — | 1.0 | 1.5 | — | 0.25 | — | 0.50 | Remainder |
| 238.2 | Ingot | 3.5–4.5 | 1.2 | 9.5–10.5 | 0.50 | 0.20–0.35 | — | 0.50 | 0.50 | — | 0.20 | — | 0.50 | Remainder |
| 240.0 | S | 0.50 | 0.50 | 7.0–9.0 | 0.30–0.7 | 5.5–6.5 | — | 0.30–0.7 | 0.10 | — | 0.20 | 0.05 | 0.15 | Remainder |
| 240.1 | Ingot | 0.50 | 0.40 | 7.0–9.0 | 0.30–0.7 | 5.8–6.5 | — | 0.30–0.7 | 0.10 | — | 0.20 | 0.05 | 0.15 | Remainder |
| 242.0 | S&P | 0.7 | 1.0 | 3.5–4.5 | 0.35 | 1.2–1.8 | 0.25 | 1.7–2.3 | 0.35 | — | 0.25 | 0.05 | 0.15 | Remainder |
| 242.1 | Ingot | 0.7 | 0.8 | 3.5–4.5 | 0.35 | 1.3–1.8 | 0.25 | 1.7–2.3 | 0.35 | — | 0.25 | 0.05 | 0.15 | Remainder |
| 242.2 | Ingot | 0.8 | 0.6 | 3.5–4.5 | 0.10 | 1.3–1.8 | — | 1.7–2.3 | 0.10 | — | 0.20 | 0.05 | 0.15 | Remainder |
| A242.0 | S | 0.6 | 0.8 | 3.7–4.5 | 0.10 | 1.2–1.7 | 0.15–0.25 | 1.8–2.3 | 0.10 | — | 0.07–0.20 | 0.05 | 0.15 | Remainder |
| A242.1 | Ingot | 0.6 | 0.6 | 3.7–4.5 | 0.10 | 1.3–1.7 | 0.15–0.25 | 1.8–2.3 | 0.10 | — | 0.07–0.20 | 0.05 | 0.15 | Remainder |
| A242.2 | Ingot | 0.35 | 0.6 | 3.7–4.5 | 0.10 | 1.3–1.7 | 0.15–0.25 | 1.8–2.3 | 0.10 | — | 0.07–0.20 | 0.05 | 0.15 | Remainder |
| 243.0 | S | 0.35 | 0.40 | 3.5–4.5 | 0.15–0.45 | 1.8–2.3 | 0.20–0.40 | 1.9–2.3 | 0.05 | — | 0.06–0.20 | 0.05[26] | 0.15 | Remainder |
| 243.1 | Ingot | 0.35 | 0.30 | 3.5–4.5 | 0.15–0.45 | 1.9–2.3 | 0.20–0.40 | 1.9–2.3 | 0.05 | — | 0.06–0.20 | 0.05[26] | 0.15 | Remainder |
| 249.0 | P | 0.05 | 0.10 | 3.8–4.6 | 0.25–0.50 | 0.25–0.50 | — | — | 2.5–3.5 | — | 0.02–0.03 | 0.03 | 0.10 | Remainder |

TABLE 2-continued

CHEMICAL COMPOSITION LIMITS [1][2]
Registered Alloys in the Form of XXX.0 Castings, XXX.1 Ingot and XXX.2 Ingot

| AA No. | Products[5] | Si | Fe | Oi | Mn | Mg | Cr | Ni | Zn | Sn | Ti | OTHERS[31] Each | OTHERS[31] Total[3] | ALUMINUM MIN[4] |
|---|---|---|---|---|---|---|---|---|---|---|---|---|---|---|
| 249.2 | Ingot | 0.05 | 0.07 | 3.8–4.6 | 0.25–0.50 | 0.30–0.50 | — | — | 2.5–3.5 | — | 0.02–0.12 | 0.03 | 0.10 | Remainder |
| 295.0 | S | 0.7–1.5 | 1.0 | 4.0–5.0 | 0.35 | 0.03 | — | — | 0.35 | — | 0.25 | 0.05 | 0.15 | Remainder |
| 295.1 | Ingot | 0.7–1.5 | 0.8 | 4.0–5.0 | 0.35 | 0.03 | — | — | 0.35 | — | 0.25 | 0.05 | 0.15 | Remainder |
| 295.2 | Ingot | 0.7–1.2 | 0.8 | 4.0–5.0 | 0.30 | 0.03 | — | — | 0.30 | — | 0.20 | 0.05 | 0.15 | Remainder |
| 296.0 | P | 2.0–3.0 | 1.2 | 4.0–5.0 | 0.35 | 0.05 | — | 0.35 | 0.50 | — | 0.25 | — | 0.35 | Remainder |
| 296.1 | Ingot | 2.0–3.0 | 0.9 | 4.0–5.0 | 0.35 | 0.05 | — | 0.35 | 0.50 | — | 0.25 | — | 0.35 | Remainder |
| 296.2 | Ingot | 2.0–3.0 | 0.8 | 4.0–5.0 | 0.30 | 0.35 | — | — | 0.30 | — | 0.20 | 0.05 | 0.15 | Remainder |
| 305.0 | S&P | 4.5–5.5 | 0.6 | 1.0–1.5 | 0.50 | 0.10 | 0.25 | — | 0.35 | — | 0.25 | 0.05 | 0.15 | Remainder |
| 305.2 | Ingot | 4.5–5.5 | 0.14–0.25 | 1.0–1.5 | 0.05 | — | — | — | 0.05 | — | 0.20 | 0.05 | 0.15 | Remainder |
| A305.0 | S&P | 4.5–5.5 | 0.20 | 1.0–1.5 | 0.10 | 0.10 | — | — | 0.10 | — | 0.20 | 0.05 | 0.15 | Remainder |
| A305.1 | Ingot | 4.5–5.5 | 0.15 | 1.0–1.5 | 0.10 | 0.10 | — | — | 0.10 | — | 0.20 | 0.05 | 0.15 | Remainder |
| A305.2 | Ingot | 4.5–5.5 | 0.13 | 1.0–1.5 | 0.05 | — | — | — | 0.05 | — | 0.20 | 0.05 | 0.15 | Remainder |
| 308.0 | S&P | 5.0–6.0 | 1.0 | 4.0–5.0 | 0.50 | 0.10 | — | — | 1.0 | — | 0.25 | — | 0.50 | Remainder |
| 308.1 | Ingot | 5.0–6.0 | 0.8 | 4.0–5.0 | 0.50 | 0.10 | — | — | 1.0 | — | 0.25 | — | 0.50 | Remainder |
| 308.2 | Ingot | 5.0–6.0 | 0.6 | 4.0–5.0 | 0.30 | 0.10 | — | — | 0.50 | — | 0.20 | — | 0.50 | Remainder |
| 319.0 | S&P | 5.5–6.5 | 1.0 | 3.0–4.0 | 0.50 | 0.10 | — | 0.35 | 1.0 | — | 0.25 | — | 0.50 | Remainder |
| 319.1 | Ingot | 5.5–6.5 | 0.8 | 3.0–4.0 | 0.50 | 0.10 | — | 0.35 | 1.0 | — | 0.25 | — | 0.50 | Remainder |
| 319.2 | Ingot | 5.5–6.5 | 0.6 | 3.0–4.0 | 0.10 | 0.10 | — | 0.10 | 0.10 | — | 0.20 | — | 0.20 | Remainder |
| A319.0 | S&P | 5.5–6.5 | 1.0 | 3.0–4.0 | 0.50 | 0.10 | — | 0.35 | 3.0 | — | 0.25 | — | 0.50 | Remainder |
| A319.1 | Ingot | 5.5–6.5 | 0.8 | 3.0–4.0 | 0.50 | 0.10 | — | 0.35 | 3.0 | — | 0.25 | — | 0.50 | Remainder |
| B319.0 | S&P | 5.5–6.5 | 1.2 | 3.0–4.0 | 0.8 | 0.10–0.50 | — | 0.50 | 1.0 | — | 0.25 | — | 0.50 | Remainder |
| B319.1 | Ingot | 5.5–6.5 | 0.9 | 3.0–4.0 | 0.8 | 0.15–0.50 | — | 0.50 | 1.0 | — | 0.25 | — | 0.50 | Remainder |
| 320.0 | S&P | 5.0–8.0 | 1.2 | 2.0–4.0 | 0.8 | 0.05–0.6 | — | 0.35 | 3.0 | — | 0.25 | — | 0.15 | Remainder |
| 320.1 | Ingot | 5.0–8.0 | 0.9 | 2.0–4.0 | 0.8 | 0.10–0.6 | — | 0.35 | 3.0 | — | 0.25 | — | 0.50 | Remainder |
| 324.0 | P | 7.0–8.0 | 1.2 | 0.40–0.6 | 0.50 | 0.40–0.7 | — | 0.30 | 1.0 | — | 0.20 | 0.15 | 0.20 | Remainder |
| 324.1 | Ingot | 7.0–8.0 | 0.9 | 0.40–0.6 | 0.50 | 0.45–0.7 | — | 0.30 | 1.0 | — | 0.20 | 0.15 | 0.20 | Remainder |
| 324.2 | Ingot | 7.0–8.0 | 0.6 | 0.40–0.6 | 0.10 | 0.45–0.7 | — | 0.10 | 0.10 | — | 0.20 | 0.05 | 0.15 | Remainder |
| 328.0 | S | 7.5–8.5 | 1.0 | 1.0–2.0 | 0.20–0.6 | 0.20–0.6 | 0.35 | 0.25 | 1.5 | — | 0.25 | — | 0.50 | Remainder |
| 328.1 | Ingot | 7.5–8.5 | 0.8 | 1.0–2.0 | 0.25–0.6 | 0.20–0.6 | 0.35 | 0.25 | 1.5 | — | 0.25 | — | 0.50 | Remainder |
| 332.0 | P | 8.5–10.5 | 1.2 | 2.0–4.0 | 0.50 | 0.50–1.5 | — | 0.50 | 1.0 | — | 0.25 | — | 0.50 | Remainder |
| 332.1 | Ingot | 8.5–10.5 | 0.9 | 2.0–4.0 | 0.50 | 0.6–1.5 | — | 0.50 | 1.0 | — | 0.25 | — | 0.50 | Remainder |
| 332.2 | Ingot | 8.5–10.0 | 0.6 | 2.0–4.0 | 0.10 | 0.9–1.3 | — | 0.10 | 0.10 | — | 0.20 | — | 0.30 | Remainder |
| 333.0 | P | 8.0–10.0 | 1.0 | 3.0–4.0 | 0.50 | 0.05–0.50 | — | 0.50 | 1.0 | — | 0.25 | — | 0.50 | Remainder |
| 333.1 | Ingot | 8.0–10.0 | 0.8 | 3.0–4.0 | 0.50 | 0.10–0.50 | — | 0.50 | 1.0 | — | 0.25 | — | 0.50 | Remainder |
| A333.0 | P | 8.0–10.0 | 1.0 | 3.0–4.0 | 0.50 | 0.05–0.50 | — | 0.50 | 3.0 | — | 0.25 | — | 0.50 | Remainder |
| A333.1 | Ingot | 8.0–10.0 | 0.8 | 3.0–4.0 | 0.50 | 0.10–0.50 | — | 0.50 | 3.0 | — | 0.25 | — | 0.50 | Remainder |
| 336.0 | P | 11.0–13.0 | 1.2 | 0.50–1.5 | 0.35 | 0.7–1.3 | — | 2.0–3.0 | 0.35 | — | 0.25 | 0.05 | — | Remainder |
| 336.1 | Ingot | 11.0–13.0 | 0.9 | 0.50–1.5 | 0.35 | 0.8–1.3 | — | 2.0–3.0 | 0.35 | — | 0.25 | 0.05 | — | Remainder |
| 336.2 | Ingot | 11.0–13.0 | 0.9 | 0.50–1.5 | 0.10 | 0.9–1.3 | — | 2.0–3.0 | 0.10 | — | 0.20 | 0.05 | 0.15 | Remainder |
| 339.0 | P | 11.0–13.0 | 1.2 | 1.5–3.0 | 0.50 | 0.50–1.5 | — | 0.50–1.5 | 1.0 | — | 0.25 | — | 0.50 | Remainder |
| 339.1 | Ingot | 11.0–13.0 | 0.9 | 1.5–3.0 | 0.50 | 0.6–1.5 | — | 0.50–1.5 | 1.0 | — | 0.25 | — | 0.50 | Remainder |
| 343.0 | D | 6.7–7.7 | 1.2 | 0.50–0.9 | 0.50 | 0.10 | 0.10 | — | 1.2–2.0 | 0.50 | — | 0.10 | 0.35 | Remainder |
| 343.1 | Ingot | 6.7–7.7 | 0.9 | 0.50–0.9 | 0.50 | 0.10 | 0.10 | — | 1.2–1.9 | 0.50 | — | 0.10 | 0.35 | Remainder |
| 354.0 | P | 8.8–9.4 | 0.20 | 1.6–2.0 | 0.10 | 0.40–0.6 | — | — | 0.10 | — | 0.20 | 0.05 | 0.15 | Remainder |

TABLE 2-continued

CHEMICAL COMPOSITION LIMITS [1][2]
Registered Alloys in the Form of XXX.0 Castings, XXX.1 Ingot and XXX.2 Ingot

| AA | Prod- | | | | | | | | | | | OTHERS[31] | | ALUMI-NUM |
|---|---|---|---|---|---|---|---|---|---|---|---|---|---|---|
| No. | ucts[5] | Si | Fe | Oi | Mn | Mg | Cr | Ni | Zn | Sn | Ti | Each | Total[3] | MIN[4] |
| 354.1 | Ingot | 8.8–9.4 | 0.15 | 1.6–2.0 | 0.10 | 0.45–0.6 | — | — | 0.10 | — | 0.20 | 0.05 | 0.15 | Remainder |
| 355.0 | S&P | 4.5–5.5 | 0.6[10] | 1.0–1.5 | 0.50[10] | 0.40–0.6 | 0.25 | — | 0.35 | — | 0.25 | 0.05 | 0.15 | Remainder |
| 355.1 | Ingot | 4.5–5.5 | 0.50[10] | 1.0–1.5 | 0.50[10] | 0.45–0.6 | 0.25 | — | 0.35 | — | 0.25 | 0.05 | 0.15 | Remainder |
| 355.2 | Ingot | 4.5–5.5 | 0.14–0.25 | 1.0–1.5 | 0.05 | 0.50–0.6 | — | — | 0.0S | — | 0.20 | 0.05 | 0.15 | Remainder |
| A355.0 | S&P | 4.5–5.5 | 0.09 | 1.0–1.5 | 0.05 | 0.45–0.6 | — | — | 0.05 | — | 0.04–0.20 | 0.05 | 0.15 | Remainder |
| A355.2 | Ingot | 4.5–5.5 | 0.06 | 1.0–1.5 | 0.03 | 0.50–0.6 | — | — | 0.03 | — | 0.04–0.20 | 0.03 | 0.10 | Remainder |
| C355.0 | S&P | 4.5–5.5 | 0.20 | 1.0–1.5 | 0.10 | 0.40–0.6 | — | — | 0.10 | — | 0.20 | 0.05 | 0.15 | Remainder |
| C355.1 | Ingot | 4.5–5.5 | 0.15 | 1.0–1.5 | 0.10 | 0.45–0.6 | — | — | 0.10 | — | 0.20 | 0.05 | 0.15 | Remainder |
| C355.2 | Ingot | 4.5–5.5 | 0.13 | 1.0–1.5 | 0.05 | 0.50–0.6 | — | — | 0.05 | — | 0.20 | 0.05 | 0.15 | Remainder |
| 356.0 | S&P | 6.5–7.5 | 0.6[10] | 0.25 | 0.35[10] | 0.20–0.45 | — | — | 0.35 | — | 0.25 | 0.05 | 0.15 | Remainder |
| 356.1 | Ingot | 6.5–7.5 | 0.50[10] | 0.25 | 0.35[10] | 0.25–0.45 | — | — | 0.35 | — | 0.25 | 0.05 | 0.15 | Remainder |
| 356.2 | Ingot | 6.5–7.5 | 0.13–0.25 | 0.10 | 0.05 | 0.30–0.45 | — | — | 0.05 | — | 0.20 | 0.05 | 0.15 | Remainder |
| A356.0 | S&P | 6.5–7.5 | 0.20 | 0.20 | 0.10 | 0.25–0.45 | — | — | 0.10 | — | 0.20 | 0.05 | 0.15 | Remainder |
| A356.1 | Ingot | 6.5–7.5 | 0.15 | 0.20 | 0.10 | 0.30–0.45 | — | — | 0.10 | — | 0.20 | 0.05 | 0.15 | Remainder |
| A356.2 | Ingot | 6.5–7.5 | 0.12 | 0.10 | 0.05 | 0.30–0.45 | — | — | 0.05 | — | 0.20 | 0.05 | 0.15 | Remainder |
| B356.0 | S&P | 6.5–7.5 | 0.09 | 0.05 | 0.05 | 0.25–0.45 | — | — | 0.05 | — | 0.04–0.20 | 0.05 | 0.15 | Remainder |
| B356.2 | Ingot | 6.5–7.5 | 0.06 | 0.03 | 0.03 | 0.30–0.45 | — | — | 0.35 | — | 0.04–0.20 | 0.03 | 0.10 | Remainder |
| *C356.0 | S&P | 6.5–7.5 | 0.07 | 0.05 | 0.05 | 0.25–0.45 | — | — | 0.05 | — | 0.04–0.20 | 0.05 | 0.15 | Remainder |
| *C356.2 | Ingot | 6.5–7.5 | 0.04 | 0.03 | 0.03 | 0.30–0.45 | — | — | 0.03 | — | 0.04–0.20 | 0.03 | 0.10 | Remainder |
| F356.0 | S&P | 6.5–7.5 | 0.20 | 0.20 | 0.10 | 0.17–0.25 | — | — | 0.10 | — | 0.04–0.20 | 0.05 | 0.15 | Remainder |
| F356.2 | Ingot | 6.5–7.5 | 0.12 | 0.10 | 0.05 | 0.17–0.25 | — | — | 0.05 | — | 0.04–0.20 | 0.05 | 0.15 | Remainder |
| 357.0 | S&P | 6.5–7.5 | 0.15 | 0.05 | 0.03 | 0.45–0.6 | — | — | 0.05 | — | 0.20 | 0.05 | 0.15 | Remainder |
| 357.1 | Ingot | 6.5–7.5 | 0.12 | 0.05 | 0.03 | 0.45–0.6 | — | — | 0.05 | — | 0.20 | 0.05 | 0.15 | Remainder |
| A357.0 | S&P | 6.5–7.5 | 0.20 | 0.20 | 0.10 | 0.40–0.7 | — | — | 0.10 | — | 0.04–0.20 | 0.05[6] | 0.15 | Remainder |
| A357.2 | Ingot | 6.5–7.5 | 0.12 | 0.10 | 0.05 | 0.45–0.7 | — | — | 0.05 | — | 0.04–0.20 | 0.03[6] | 0.10 | Remainder |
| B357.0 | S&P | 6.5–7.5 | 0.09 | 0.05 | 0.05 | 0.40–0.6 | — | — | 0.05 | — | 0.04–0.20 | 0.05 | 0.15 | Remainder |
| B357.2 | Ingot | 6.5–7.5 | 0.06 | 0.03 | 0.03 | 0.45–0.6 | — | — | 0.03 | — | 0.04–0.20 | 0.03 | 0.10 | Remainder |
| C357.0 | S&P | 6.5–7.5 | 0.09 | 0.05 | 0.05 | 0.45–0.7 | — | — | 0.05 | — | 0.04–0.20 | 0.05[6] | 0.15 | Remainder |
| C357.2 | Ingot | 6.5–7.5 | 0.06 | 0.03 | 0.03 | 0.50–0.7 | — | — | 0.03 | — | 0.04–0.20 | 0.03[6] | 0.10 | Remainder |
| *D357.0 | S | 6.5–7.5 | 0.20 | — | 0.10 | 0.55–0.6 | — | — | — | — | 0.10–0.20 | 0.05[6] | 0.15 | Remainder |
| 358.0 | S&P | 7.6–8.6 | 0.30 | 0.20 | 0.20 | 0.40–0.6 | 0.20 | — | 0.20 | — | 0.10–0.20 | 0.05[15] | 0.15 | Remainder |
| 358.2 | Ingot | 7.6–8.6 | 0.20 | 0.10 | 0.10 | 0.50–0.6 | 0.05 | — | 0.10 | — | 0.12–0.20 | 0.05[16] | 0.15 | Remainder |
| 359.0 | S&P | 8.5–9.5 | 0.20 | 0.20 | 0.10 | 0.50–0.7 | — | — | 0.10 | — | 0.20 | 0.05 | 0.15 | Remainder |
| 359.2 | Ingot | 8.5–9.5 | 0.12 | 0.10 | 0.10 | 0.55–0.7 | — | — | 0.10 | — | 0.20 | 0.05 | 0.15 | Remainder |
| 360.0[11] | D | 9.0–10.0 | 2.0 | 0.6 | 0.35 | 0.40–0.6 | — | 0.50 | 0.50 | 0.15 | — | — | 0.25 | Remainder |
| 360.2 | Ingot | 9.0–10.0 | 0.1–1.1 | 0.10 | 0.10 | 0.45–0.6 | — | 0.10 | 0.10 | 0.10 | — | — | 0.20 | Remainder |
| A360.0[11] | D | 9.0–10.0 | 1.3 | 0.6 | 0.35 | 0.40–0.6 | — | 0.50 | 0.50 | 0.15 | — | — | 0.25 | Remainder |
| A360.1[11] | Ingot | 9.0–10.0 | 1.0 | 0.6 | 0.35 | 0.45–0.6 | — | 0.50 | 0.40 | 0.15 | — | — | 0.25 | Remainder |
| A360.2 | Ingot | 9.0–10.0 | 0.6 | 0.10 | 0.05 | 0.45–0.6 | — | — | 0.05 | — | — | 0.05 | 0.15 | Remainder |
| 361.0 | D | 9.5–10.5 | 1.1 | 0.50 | 0.25 | 0.40–0.6 | 0.20–0.30 | 0.20–0.30 | 0.50 | 0.10 | 0.20 | 0.05 | 0.15 | Remainder |
| 361.1 | Ingot | 9.5–10.5 | 0.8 | 0.50 | 0.25 | 0.45–0.6 | 0.20–0.30 | 0.30–0.30 | 0.40 | 0.10 | 0.20 | 0.05 | 0. 15 | Remainder |
| 363.0 | S&P | 4.5–6.0 | 1.1 | 2.5–3.5 | [17] | 0.15–0 40 | [17] | 0.25 | 3.0–4.5 | 0.25 | 0.20 | [18] | 0.30 | Remainder |
| 363.1 | Ingot | 4.5–6.0 | 0.8 | 2.5–3:5 | [17] | 0.20–0.60 | [17] | 0.25 | 3.0–4.5 | 0.25 | 0.20 | [18] | 0.30 | Remainder |
| 364.0 | D | 7.5–9.5 | 1.5 | 0.20 | 0.10 | 0.20–0.40 | 0.25–0.50 | 0.15 | 0.15 | 0.15 | — | 0.05[12] | 0.15 | Remainder |

TABLE 2-continued

CHEMICAL COMPOSITION LIMITS [1][2]
Registered Alloys in the Form of XXX.0 Castings, XXX.1 Ingot and XXX.2 Ingot

| AA | Prod- | | | | | | | | | | | OTHERS[31] | | ALUMI-NUM |
|---|---|---|---|---|---|---|---|---|---|---|---|---|---|---|
| No. | ucts[5] | Si | Fe | Oi | Mn | Mg | Cr | Ni | Zn | Sn | Ti | Each | Total[3] | MIN[4] |
| 364.2 | Ingot | 7.5–9.5 | 0.7–1.1 | 0.20 | 0. 10 | 0.25–0.40 | 0.25–0.50 | 0. 15 | 0. 1, | 0.15 | — | 0.05[12] | 0.15 | Remainder |
| 369.0 | D | 11.0–12.0 | 1.3 | 0.50 | 0.35 | 0.25–0.45 | 0.30–0.40 | 0.05 | . 1.0 | 0.10 | — | 0.05 | 0.15 | Remainder |
| 369.1 | Ingot | 11.0–12.0 | 1.0 | 0.50 | 0.35 | 0.30–0.45 | 0.30–0.40 | 0.05 | 0.9 | 0.10 | — | 0.05 | 0.15 | Remainder |
| 380.0[11] | D | 7.5–9.5 | 2.0 | 3.0–4.0 | 0.50 | 0.10 | — | 0.50 | 3.0 | 0.35 | — | — | 0.15 | Remainder |
| 380.2 | Ingot | 7.5–9.5 | 0.7–1.1 | 3.0–4.0 | 0.10 | 0.10 | — | 0.10 | 0.10 | 0.10 | — | — | 0.20 | Remainder |
| A380.0[11] | D | 7.5–9.5 | 1.3 | 3.0–4.0 | 0.50 | 0.10 | — | 0.50 | . 3.0 | 0.35 | — | — | 0.30 | Remainder |
| A380.1[11] | Ingot | 7.5–9.5 | 1.0 | 3.0–4.0 | 0.50 | 0.10 | — | 0.50 | 2.9 | 0.35 | — | — | 0.30 | Remainder |
| A380.2 | Ingot | 1.5–9.5 | 0.6 | 3.0–4.0 | 0.10 | 0.10 | — | 0. 10 | 0. 10 | — | — | 0.05 | 0.15 | Remainder |
| B380.0 | D | 7.5–9.5 | 1.3 | 3.0–4.0 | 0.50 | 0.10 | — | 0.50 | 1.C | 0,35 | — | — | 0.50 | Remainder |
| B380.1 | Ingot | 7.5–9.5 | 1.0 | 3.0–4.0 | 0.50 | 0.10 | — | 0.50 | 0.9 | 0.35 | — | — | 0.50 | Remainder |
| 380.0 | D | 9.5–11.5 | 1.3 | 2.0–3.0 | 0.50 | 0.10 | — | 0.30 | 3.0 | 0.15 | — | — | 0.50 | Remainder |
| 383.1 | Ingot | 9.5.–11.5 | 1.0 | 2.0–3.0 | 0.50 | 0.10 | — | 0.30 | 2.9 | 0.15 | — | — | 0.50 | Remainder |
| 383.2 | Ingot | 9.5–11.5 | 0.6–1.0 | 2.0–3.0 | 0.10 | 0.10 | — | 0.10 | 0.10 | 0.10 | — | — | 0.20 | Remainder |
| 384.0 | D | 10.5–12.0 | 1.3 | 3.0–4.5 | 0.50 | 0.10 | — | 0.50 | 3.0 | 0.35 | — | — | 0.50 | Remainder |
| 384.1 | Ingot | 10.5–12.0 | 1.0 | 3.0–4.5 | 0.50 | 0.10 | — | 0.50 | 2.9 | 0.35 | — | — | 0.50 | Remainder |
| 384.2 | Ingot | 10.5–12.0 | 0.6–1.0 | 3.0–4.5 | 0.10 | 0.10 | — | 0.10 | 0.10 | 0.10 | — | — | 0.20 | Remainder |
| A384.0 | D | 10.5–12.0 | 1.3 | 3.0–4.5 | 0.50 | 0.10 | — | 0.50 | 1.0 | 0.35 | — | — | 0.50 | Remainder |
| A384.1 | Ingot | 10.5–12.0 | 1.0 | 3.0–4.5 | 0.50 | 0.10 | — | 0.50 | 0.9 | 0.35 | — | — | 0.50 | Remainder |
| 385.0 | D | 11.0–13.0 | 2.0 | 2.0–4.0 | 0.50 | 0.30 | — | 0.50 | 3.0 | 0.30 | — | — | 0.50 | Remainder |
| 385.1 | Ingot | 11.0–13.0 | 1.1 | 2.0–4.0 | 0.50 | 0.30 | — | 0.50 | 2.9 | 0.30 | — | — | 0.50 | Remainder |
| 390.0 | D | 16.0–18.0 | 1.3 | 4.0–5.0 | 0.1.0 | 0.45–0.65 | — | — | 0. 10 | — | 0.20 | 0.10 | 0.20 | Remainder |
| 390.2 | Ingot | 16.0–18.0 | 0.6–1.0 | 4.0–5.0 | 0.10 | 0.50–0.65 | — | — | 0.10 | — | 0.20 | 0.10 | 0.20 | Remainder |
| A390.0 | S&P | 16.0–18.0 | 0.50 | 4.0–5.0 | 0.10 | 0.45–0.65 | — | — | 0.10 | — | 0.20 | 0.10 | 0.20 | Remainder |
| A390.1 | Ingot | 16.0–18.0 | 0.40 | 4.0–5.0 | 0.10 | 0.50–0.65 | — | — | 0.10 | — | 0.20 | 0.10 | 0.20 | Remainder |
| B390.0 | D | 16.0–18.0 | 1.3 | 4.0–5.0 | 0.50 | 0.45–0.65 | — | 0.10 | 1.5 | — | 0.20 | 0.10 | 0.20 | Remainder |
| B390.1 | Ingot | 16.0–18.0 | 1.0 | 4.0–5.0. | 0.50 | 0.50–0.65 | — | 0.10 | 1.4 | — | 0.20 | 0.10 | 0.20 | Remainder |
| 392.0 | D | 18.0–20.0 | 1.5 | 0.40–0.8 | 0.20–0.6 | 0.8–1.2 | — | 0.50 | 0.50 | 0.30 | 0.20 | 0.15 | 0.50 | Remainder |
| 392.1 | Ingot | 18.0–20.0 | 1.1 | 0.40–0.8 | 0.20–0.6 | 0.9–1.2 | — | 0.50 | 0.40 | 0.30 | 0.20 | 0.15 | 0.50 | Remainder |
| 393.0 | SP&D | 21.0–23.0 | 1.3 | 0.7–1.1 | 0.10 | 0.7–1.3 | — | 2.0–2.5 | 0.10 | — | 0.10–0.20 | 5[14] | 0.15 | Remainder |
| 393.1 | Ingot | 21.0–23.0 | 1.0 | 0.7–1.1 | 0.10 | 0.8–1.3 | — | 2.0–2.5 | 0.10 | — | 0.10–0.20 | 0.05[14] | 0.15 | Remainder |
| 393.2 | Ingot | 21.0–23.0 | 0.8 | 0.7–1.1 | 0.10 | 0.8–1.3 | — | 2.0–2.5 | 0.10 | — | 0.10–0.20 | 0.05[14] | 0.15 | Remainder |
| 408.2[25] | Ingot | 8.5–9.5 | 0.6–1.3 | 0.10 | 0.10 | — | — | — | 0.10 | — | — | 0.10 | 0.20 | Remainder |
| 409.2[25] | Ingot | 9.0–10.0 | 0.6–1.3 | 0.10 | 0.10 | — | — | — | 0.10 | — | — | 0.10 | 0.20 | Remainder |
| 411.2[25] | Ingot | 10.0–12.0 | 0.6–1.3 | 0.20 | 0.10 | — | — | — | 0.10 | — | — | 0.10 | 0.20 | Remainder |
| 413.0[11] | D | 11.0–13.0 | 2.0 | 1.0 | 0.35 | 0.10 | — | 0.50 | 0.50 | 0.15 | — | — | 0.25 | Remainder |
| 413.2 | Ingot | 11.0–13.0 | 0.7–1.1 | 0.10 | 0.10 | 0.07 | — | 0.10 | 0.10 | 0.10 | — | — | 0.20 | Remainder |
| A413.0[11] | D | 11.0–13.0 | 1.3 | 1.0 | 0.35 | 0.10 | — | 0.50 | 0.50 | 0.15 | — | — | 0.25 | Remainder |
| A413.1[11] | Ingot | 11.0–13.0 | 1.0 | 1.0 | 0.35 | 0.10 | — | 0.50 | 0.40 | 0.15 | — | — | 0.25 | Remainder |
| A413.2 | Ingot | 11.0–13.0 | 0.6 | 0.10 | 0.05 | 0.05 | — | 0.05 | 0.05 | 0.05 | — | — | 0.10 | Remainder |
| *B413.0 | S&P | 11.0–13.0 | 0.50 | 0.10 | 0.35 | 0.05 | — | 0.05 | 0.10 | — | 0.25 | 0.05 | 0.20 | Remainder |
| *B413.1 | Ingot | 11.0–13.0 | 0.40 | 0.10 | 0.35 | 0.05 | — | 0.05 | 0.10 | — | 0.25 | 0.05 | 0.20 | Remainder |
| 435.2[27] | Ingot | 3.3–3.9 | 0.40 | 0.05 | 0.05 | 0.05 | — | — | 0.10 | — | — | 0.05 | 0.20 | Remainder |
| 443.0 | S&P | 4.5–6.0 | 0.8 | 0.6 | 0.50 | 0.05 | 0.25 | — | 0.50 | — | 0.25 | — | 0.35 | Remainder |
| 443.1 | Ingot | 4.5–6.0 | 0.6 | 0.6 | 0.50 | 0.05 | 0.25 | — | 0.50 | — | 0.25 | — | 0.35 | Remainder |

TABLE 2-continued

CHEMICAL COMPOSITION LIMITS [1][2]
Registered Alloys in the Form of XXX.0 Castings, XXX.1 Ingot and XXX.2 Ingot

| AA | Prod- | | | | | | | | | | | OTHERS[31] | | ALUMI-NUM |
|---|---|---|---|---|---|---|---|---|---|---|---|---|---|---|
| No. | ucts[5] | Si | Fe | Oi | Mn | Mg | Cr | Ni | Zn | Sn | Ti | Each | Total[3] | MIN[4] |
| 443.2 | Ingot | 4.5–6.0 | 0.6 | 0.10 | 0.10 | 0.05 | — | — | 0.10 | — | 0.20 | 0.05 | 0.15 | Remainder |
| A443.0 | S | 4.5–6.0 | 0.8 | 0.30 | 0.50 | 0.05 | 0.25 | — | 0.50 | — | 0.25 | — | 0.35 | Remainder |
| A443.1 | Ingot | 4.5–6.0 | 0.6 | 0.30 | 0.50 | 0.05 | 0.25 | — | 0.50 | — | 0.25 | — | 0.35 | Remainder |
| B443.0 | S&P | 4.5–6.0 | 0.8 | 0.15 | 0.35 | 0.05 | — | — | 0.35 | — | 0.25 | 0.10 | 0.15 | Remainder |
| B443.1 | Ingot | 4.5–6.0 | 0.6 | 0.15 | 0.35 | 0.05 | — | — | 0.35 | — | 0.25 | 0.05 | 0.15 | Remainder |
| C443.0 | D | 4.5–6.0 | 2.0 | 0.6 | 0.35 | 0.10 | — | 0.50 | 0.50 | 0.15 | — | — | 0.25 | Remainder |
| C443.1 | Ingot | 4.5–6.0 | 1.1 | 0.6 | 0.35 | 0.10 | — | 0.50 | 0.40 | 0.15 | — | — | 0.25 | Remainder |
| C443.2 | Ingot | 4.5–6.0 | 0.7–1.1 | 0.10 | 0.10 | 0.05 | — | — | 0.10 | — | — | 0.05 | 0.15 | Remainder |
| 444.0 | S&P | 6.5–7.5 | 0.6 | 0.25 | 0.35 | 0.10 | — | — | 0.35 | — | 0.25 | 0.05 | 0.15 | Remainder |
| 444.2 | Ingot | 6.5–7.5 | 0.13–0.25 | 0.10 | 0.05 | 0.05 | — | — | 0.05 | — | 0.20 | 0.05 | 0.15 | Remainder |
| A444.0 | P | 6.5–7.5 | 0.20 | 0.10 | 0.10 | 0.05 | — | — | 0.10 | — | 0.20 | 0.05 | 0.15 | Remainder |
| A444.1 | Ingot | 6.5–7.5 | 0.15 | 0.10 | 0.10 | 0.05 | — | — | 0.10 | — | 0.20 | 0.05 | 0.15 | Remainder |
| A444.2 | Ingot | 6.5–7.5 | 0.12 | 0.05 | 0.05 | 0.05 | — | — | 0.05 | — | 0.20 | 0.05 | 0.15 | Remainder |
| 445.2[25] | Ingot | 6.5–7.5 | 0.6–1.3 | 0.10 | 0.10 | — | — | — | 0.10 | — | — | 0.10 | 0.20 | Remainder |
| 511.0 | S | 0.30–0.7 | 0.50 | 0.15 | 0.35 | 3.5–4.5 | — | — | 0.15 | — | 0.25 | 0.05 | 0.15 | Remainder |
| 511.1 | Ingot | 0.30–0.7 | 0.40 | 0.15 | 0.35 | 3.6–4.5 | — | — | 0.15 | — | 0.25 | 0.05 | 0.15 | Remainder |
| 511.2 | Ingot | 0.30–0.7 | 0.30 | 0.10 | 0.10 | 3.6–4.5 | — | — | 0.10 | — | 0.20 | 0.05 | 0.15 | Remainder |
| 512.0 | S | 1.4–2.2 | 0.6 | 0.35 | 0.8 | 3.5–4.5 | 0.25 | — | 0.35 | — | 0.25 | 0.05 | 0.15 | Remainder |
| 512.2 | Ingot | 1.4–2.2 | 0.30 | 0.10 | 0.10 | 3.6–4.5 | — | — | 0.10 | — | 0.20 | 0.05 | 0.15 | Remainder |
| 513.0 | P | 0.30 | 0.40 | 0.10 | 0.30 | 3.5–4.5 | — | — | 1.4–2.2 | — | 0.20 | 0.05 | 0.15 | Remainder |
| 513.2 | Ingot | 0.30 | 0.30 | 0.10 | 0.10 | 3.6–4.5 | — | — | 1.4–2.2 | — | 0.20 | 0.05 | 0.15 | Remainder |
| 514.0 | S | 0.35 | 0.50 | 0.15 | 0.35 | 3.5–4.5 | — | — | 0.15 | — | 0.25 | 0.05 | 0.15 | Remainder |
| 514.1 | Ingot | 0.35 | 0.40 | 0.15 | 0.35 | 3.6–4.5 | — | — | 0.15 | — | 0.25 | 0.05 | 0.15 | Remainder |
| 514.2 | Ingot | 0.30 | 0.30 | 0.10 | 0.10 | 3.6–4.5 | — | — | 0.10 | — | 0.20 | 0.05 | 0.15 | Remainder |
| 515.0 | D | 0.50–1.0 | 1.3 | 0.20 | 0.40–0.6 | 2.5–4.0 | — | — | 0.10 | — | — | 0.05 | 0.15 | Remainder |
| 515.2 | Ingot | 0.50–1.0 | 0.6–1.0 | 0.10 | 0.40–0.6 | 2.7–4.0 | — | — | 0.05 | — | — | 0.05 | 0.15 | Remainder |
| 516.0 | D | 0.30–1.5 | 0.35–1.0 | 0.30 | 0.15–0.40 | 2.5–4.5 | — | 0.25–0.40 | 0.20 | 0.10 | 0.10–0.20 | 0.05[28] | — | Remainder |
| 516.1 | Ingot | 0.30–1.5 | 0.35–0.7 | 0.30 | 0.15–0.40 | 2.6–4.5 | — | 0.25–0.40 | 0.20 | 0.10 | 0.10–0.20 | 0.05[28] | — | Remainder |
| 518.0 | D | 0.35 | 1.8 | 0.25 | 0.35 | 7.5–8.5 | — | 0.15 | 0.15 | 0.15 | — | — | 0.25 | Remainder |
| 518.1 | Ingot | 0.35 | 1.1 | 0.25 | 0.35 | 7.6–8.5 | — | 0.15 | 0.15 | 0.15 | — | — | 0.25 | Remainder |
| 518.2 | Ingot | 0.25 | 0.7 | 0.10 | 0.10 | 7.6–8.5 | — | 0.05 | — | 0.05 | — | — | 0.10 | Remainder |
| 520.0 | S | 0.25 | 0.30 | 0.25 | 0.15 | 9.5–10.6 | — | — | 0.15 | — | 0.25 | 0.05 | 0.15 | Remainder |
| 520.2 | Ingot | 0.15 | 0.20 | 0.20 | 0.10 | 9.6–10.6 | — | — | 0.10 | — | 0.20 | 0.05 | 0.15 | Remainder |
| 535.0 | S | 0.15 | 0.15 | 0.05 | 0.10–0.25 | 6.2–7.5 | — | — | — | — | 0.10–0.25 | 0.05[8] | 0.15 | Remainder |
| 535.2 | Ingot | 0.10 | 0.10 | 0.05 | 0.10–0.25 | 6.6–7.5 | — | — | — | — | 0.10–0.25 | 0.05[29] | 0.15 | Remainder |
| A535.0 | S | 0.20 | 0.20 | 0.10 | 0.10–0.25 | 6.5–7.5 | — | — | — | — | 0.25 | 0.05 | 0.15 | Remainder |
| A535.1 | Ingot | 0.20 | 0.15 | 0.10 | 0.10–0.25 | 6.6–7.5 | — | — | — | — | 0.25 | 0.05 | 0.15 | Remainder |
| B535.0 | S | 0.15 | 0.15 | 0.10 | 0.05 | 6.5–7.5 | — | — | — | — | 0.10–0.25 | 0.05 | 0.15 | Remainder |
| B535.2 | Ingot | 0.10 | 0.12 | 0.05 | 0.05 | 6.6–7.5 | — | — | — | — | 0.10–0.25 | 0.05 | 0.15 | Remainder |
| 705.0 | S&P | 0.20 | 0.8 | 0.20 | 0.40–0.6 | 1.4–1.8 | 0.20–0.40 | — | 2.7–3.3 | — | 0.25 | 0.05 | 0.15 | Remainder |
| 705.1 | Ingot | 0.20 | 0.6 | 0.20 | 0.40–0.6 | 1.5–1.8 | 0.20–0.40 | — | 2.7–3.3 | — | 0.25 | 0.05 | 0.15 | Remainder |
| 707.0 | S&P | 0.20 | 0.8 | 0.20 | 0.40–0.6 | 1.8–2.4 | 0.20–0.40 | — | 4.0–4.5 | — | 0.25 | 0.05 | 0.15 | Remainder |
| 707.1 | Ingot | 0.20 | 0.6 | 0.20 | 0.40–0.6 | 1.9–2.4 | 0.20–0.40 | — | 4.0–4.5 | — | 0.25 | 0.05 | 0.15 | Remainder |
| 710.0 | S | 0.15 | 0.50 | 0.35–0.65 | 0.05 | 0.6–0.8 | — | — | 6.0–7.0 | — | 0.25 | 0.05 | 0.15 | Remainder |

TABLE 2-continued

CHEMICAL COMPOSITION LIMITS [1][2]
Registered Alloys in the Form of XXX.0 Castings, XXX.1 Ingot and XXX.2 Ingot

| AA No. | Products[5] | Si | Fe | Oi | Mn | Mg | Cr | Ni | Zn | Sn | Ti | OTHERS[31] Each | OTHERS[31] Total[3] | ALUMINUM MIN[4] |
|---|---|---|---|---|---|---|---|---|---|---|---|---|---|---|
| 710.1 | Ingot | 0.15 | 0.40 | 0.35–0.65 | 0.05 | 0.65–0.8 | — | — | 6.0–7.0 | — | 0.25 | 0.05 | 0.15 | Remainder |
| 711.0 | P | 0.30 | 0.7–1.4 | 0.35–0.65 | 0.05 | 0.25–0.45 | — | — | 6.0–7.0 | — | 0.20 | 0.05 | 0.15 | Remainder |
| 711.1 | Ingot | 0.30 | 0.7–1.1 | 0.35–0.65 | 0.05 | 0.30–0.45 | — | — | 6.0–7.0 | — | 0.20 | 0.05 | 0.15 | Remainder |
| 712.0 | S | 0.30 | 0.50 | 0.25 | 0.10 | 0.50–0.65 | 0.40–0.6 | — | 5.0–6.5 | — | 0.15–0.25 | 0.05 | 0.20 | Remainder |
| 712.2 | Ingot | 0.15 | 0.40 | 0.25 | 0.10 | 0.50–0.65 | 0.40–0.6 | — | 5.0–6.5 | — | 0.15–0.25 | 0.05 | 0.20 | Remainder |
| 713.0 | S&P | 0.25 | 1.1 | 0.40–1.0 | 0.6 | 0.20–0.50 | 0.35 | 0.15 | 7.0–8.0 | — | 0.25 | 0.10 | 0.25 | Remainder |
| 713.1 | Ingot | 0.25 | 0.8 | 0.50–1.0 | 0.6 | 0.25–0.50 | 0.35 | 0.15 | 7.0–8.0 | — | 0.25 | 0.10 | 0.25 | Remainder |
| 771.0 | S | 0.15 | 0.15 | 0.10 | 0.10 | 0.8–1.0 | 0.06–0.20 | — | 6.5–7.5 | — | 0.10–0.20 | 0.05 | 0.15 | Remainder |
| 771.2 | Ingot | 0.10 | 0.10 | 0.10 | 0.10 | 0.85–1.0 | 0.06–0.20 | — | 6.5–7.5 | — | 0.10–0.20 | 0.05 | 0.15 | Remainder |
| 772.0 | S | 0.15 | 0.15 | 0.10 | 0.10 | 0.6–0.8 | 0.06–0.20 | — | 6.0–7.0 | — | 0.10–0.20 | 0.01 | 0.15 | Remainder |
| 772.2 | Ingot | 0.10 | 0.10 | 0.10 | 0.10 | 0.65–0.8 | 0.06–0.20 | — | 6.0–7.0 | — | 0.10–0.20 | 0.05 | 0.15 | Remainder |
| 850.0 | S&P | 0.7 | 0.7 | 0.7–1.3 | 0.10 | 0.10 | — | 0.7–1.3 | — | 5.5–7.0 | 0.20 | — | 0.30 | Remainder |
| 850.1 | Ingot | 0.7 | 0.50 | 0.7–1.3 | 0.10 | 0.10 | — | 0.7–1.3 | — | 5.5–7.0 | 0.20 | — | 0.30 | Remainder |
| 851.0 | S&P | 2.0–3.0 | 0.7 | 0.7–1.3 | 0.10 | 0.10 | — | 0.30–0.7 | — | 5.5–7.0 | 0.20 | — | 0.30 | Remainder |
| 851.1 | Ingot | 2.0–3.0 | 0.50 | 0.7–1.3 | 0.10 | 0.10 | — | 0.30–0.7 | — | 5.5–7.0 | 0.20 | — | 0.30 | Remainder |
| 852.0 | S&P | 0.40 | 0.7 | 1.7–2.3 | 0.10 | 0.6–0.9 | — | 0.9–1.5 | — | 5.5–7.0 | 0.20 | — | 0.30 | Remainder |
| 852.1 | Ingot | 0.40 | 0.50 | 1.7–2.3 | 0.10 | 0.7–0.9 | — | 0.9–1.5 | — | 5.5–1.0 | 0.20 | — | 0.30 | Remainder |
| 853.0 | S&P | 5.5–6.5 | 0.7 | 3.0–4.0 | 0.50 | — | — | — | — | 5.5–7.0 | 0.20 | — | 0.30 | Remainder |
| 853.2 | Ingot | 5.5–6.5 | 0.50 | 3.0–4.0 | 0.10 | — | — | — | — | 5.5–7.0 | 0.20 | — | 0.30 | Remainder |

NOTES:
Ingot designated XXX.1 has chemical compositions limits identical to those assigned to the casting (XXX.0) except grain refining elements and except for the following provisions:

| Maximum Iron Percentages: for Sand and Permanent Mold Castings | For Ingot |
|---|---|
| Up thru 0.15 | 0.03 less than casting |
| Over 0.15 thru 0.25 | 0.05 less than castings |
| Over 0.25 thru 0.6 | 0.10 less than castings |
| Over 0.6 thru 1.0 | 0.2 less than castings |
| Over 1.0 | 0.3 less than castings |
| **For Die Castings** | **For Ingot** |
| Up thru 1.3 | 0.3 less than castings |
| Over 1.3 | 1.1 maximum |
| **Maximum Magnesium Percentage:** | **For Ingot** |
| For All Castings | 0.05 more than castings[a] |
| Less than 0.50 | 0.1 more than castings[a] |
| 0.50 and greater | |
| **Maximum Zin Percentage:** | **For Ingot** |
| For Die Castings | 0.10 less than castings |

TABLE 2-continued

CHEMICAL COMPOSITION LIMITS [1][2]
Registered Alloys in the Form of XXX.0 Castings, XXX.1 Ingot and XXX.2 Ingot

| AA No. | Products[5] | Si | Fe | Oi | Mn | Mg | Cr | Ni | Zn | Sn | Ti | OTHERS[31] Each | OTHERS[31] Total[3] | ALUMINUM MIN[4] |
|---|---|---|---|---|---|---|---|---|---|---|---|---|---|---|
| Over 0.25 thru 0.6 | | | | 0.1 less than castings | | | | | | | | | | |
| Over 0.6 | | | | | | | | | | | | | | |

[a]Applicable only to the extent that the resulting magnesium range will not be less than 0.15 percent. Ingot designated XXX.2 has chemical composition limits which differ from, but fall within, those prescribed for XXX.1 Ingot.

[1/]Composition in weight percent maximum unless shown as a range or a minimum.

Standard limits for alloying elements and impurities are expressed to the following places:

Less than .001 percent ... 0.000X

.001 but less than .01 percent ... 0.00X

.01 but less than .10 percent

Unalloyed aluminum made by a refining process ... 0.0XX

Alloys and unalloyed aluminum not made by a refining process ... 0.0X

.10 through .55 percent ... 0.XX (It is customary to express limits of 0.30 percent through 0.55 percent as 0.X0 or 0.X5)

Over .55 percent ... 0.X, X.X, etc. 9/

[2/]Except for "Aluminum" and "Others," analysis normally is made for elements for which specific limits are shown. For purposes of determining conformance to these limits, an observed value or calculated value obtained from analysis is rounded off to the nearest unit in the last right hand place of figures used in expressing the specified limit. In accordance with the following:

When the figure next beyond the last figure or place to be retained is less than 5, the figure in the last place retained should be kept unchanged.

When the figure next beyond the last figure or place to be retained is greater than 5, the figure in the last place retained should be increased by 1.

When the figure next beyond the last figure or place to be retained is 5 and (1) there are no figures or only zeros, beyond this 5, if the figure in the last place to be retained is odd. It should be increased by 1, if even. It should be kept unchanged.

(2) If the 5 next beyond the figure in the last place to be retained is followed by any figures other than zero, the figure in the last place retained should be increased by 1 whether odd or even.

[3/]The sum of those "Others" metallic elements 0.010 percent or more each, expressed to the second decimal before determining the sum.

[4/]The aluminum content for unalloyed aluminum not made by a refining process is the difference between 100.00 percent and the sum of all other metallic elements present in amounts of 0.010 percent or more each, expressed to the second decimal before determining the sum.

[5/]D = Die Casting. P = Permanent Mold. S = Sand. Other products may pertain to the composition shown even though not listed.

[6/]Beryllium 0.04–0.07.

[7/]Silver 0.40–1.0.

[8/]Beryllium 0.003–0.007, boron 0.005 max.

[9/]Magnesium percent for some alloys is an exception to this rule.

[10/]If iron exceeds 0.45, manganese content shall not be less than one-half iron content.

[11/]A360.1, A380.1 nd A413.1 ingot is used to produce 360.0 and A360.0; 380.0 and A380.0; 413.0 and A413.0 castings, respectively.

[12/]Boryllium 0.20–0.04.

[13/]Vanadium 0.05–0.15; zirconium 0.10–0.25.

[14/]Vanadium 0.08–0.15.

[15/]Beryllium 0.10–0.30.

[16/]Beryllium 0.15–0.30.

[17/]Manganese + chromium 0.8 max.

[18/]Lead 0.25 max.

[19/]Iron/silicon ratio 2.5 min.

[20/]Manganese + chromium + titanium + vanadium 0.025 max.

[21/]Iron/silicon ratio 2.0 min.

[22/]Iron/silicon ratio 1.5 min.

[23/]Antimony 0.20–0.30; cobalt 0.20–0.30; zirconium 0.10–0.30.

[24/]Titanium + zirconium 0.50 max.

TABLE 2-continued

CHEMICAL COMPOSITION LIMITS [1][2]
Registered Alloys in the Form of XXX.0 Castings, XXX.1 Ingot and XXX.2 Ingot

| AA No. | Products[5] | Si | Fe | Oi | Mn | Mg | Cr | Ni | Zn | Sn | Ti | OTHERS[31] Each | OTHERS[31] Total[3] | ALUMINUM MIN[4] |
|---|---|---|---|---|---|---|---|---|---|---|---|---|---|---|

[25]445.2, 408.2, 409.2 and 411.2 are used to coat steel.
[26]Vanadium 0.06–0.20.
[27]Used with zinc to coat steel.
[28]Lead 0.10 max.
[29]Beryllium 0.003–0.007, boron 0.002.
[30]Silver 0.50–1.0.
[31]Includes listed elements for which no specific limit is shown.
+ AA number registered since previous issue.
± Composition limits revised since previous issue.
§ −x+ removed from AA number since previous issue.
− Rated minimum conductivities:

| Ingot | Percent IACS |
|---|---|
| 100.1 | 54 |
| 130.1 | 55 |
| 150.1 | 57 |
| 170.1 | 59 |

The rating of ingot metal for minimum conductivity characteristic is based on established relations between electrical conductivity and metal composition.

TABLE 3

| Preferred Aluminum Base Alloys | |
|---|---|
| Wrought | Cast |
| 2011 | 201 |
| 2014 | 206 |
| 2024 | 319 |
| 2124 | 354 |
| 2224 | 355 |
| 2324 | 356 |
| 3002 | 357 |
| 3003 | 380 |
| 3004 | 383 |
| 3010 | 384 |
| 5052 | 390 |
| 5082 | 392 |
| 5083 | 393 |
| 5150 | 408 |
| 5182 | 409 |
| 5250 | 411 |
| 5252 | 413 |
| 5357 | 443 |
| 5454 | 444 |
| 5457 | 5XX (all) |
| 5657 | 7XX (all) |
| 6XXX (all) | |
| 7XXX (all) | |
| 8XXX (all) | |

What is claimed is:

1. A master alloy hardener for use in preparing an aluminum base alloy containing 2 or more alloying elements, consisting essentially of the alloying elements in said aluminum base alloy selected from the group consisting of silicon, iron, chromium, zinc, copper, magnesium, manganese, nickel, lead, bismuth, zirconium, boron, strontium, titanium, beryllium, sodium, calcium, phosphorous and antimony and mixtures thereof at concentrations that are a multiple equal to or greater than 2 and up to 50 of the concentrations of said alloying elements in said base alloy, wherein the ratios of the concentrations of said alloying elements in said master alloy hardener to each other are the same as the ratios of the concentrations of said alloying elements to each other in said base alloy wherein said base alloy is selected from the group consisting of a cast or ingot aluminum alloy and a wrought aluminum alloy.

2. A master alloy hardener for use in preparing an aluminum base alloy, said master alloy hardener containing 2 or more alloying elements consisting essentially of the alloying elements in said aluminum base alloy selected from the group consisting of silicon, iron, chromium, zinc, copper, magnesium, manganese, nickel, lead, bismuth, zirconium, boron, strontium, titanium, beryllium, sodium, calcium, phosphorous and antimony and mixtures thereof, wherein the ratios of the concentrations of said alloying elements in said master alloy hardener to each other are the same as the ratios of the concentrations of said alloying elements to each other in said base alloy, and wherein said alloying elements are present in said master alloy hardener at concentrations which are a multiple of from 2 to 50 of the concentrations of said alloying elements in said base alloy.

3. The master alloy hardener of claim 2 further consisting essentially of a grain refiner or a grain modifier, wherein said grain refiner or grain modifier is physically surrounded by said master alloy hardener.

4. The master alloy hardener of claim 2 further consisting essentially of a grain refiner and a grain modifier, wherein said grain refiner and said grain modifier are physically surrounded by said master alloy hardener.

5. The master alloy hardener of claim 2 further consisting essentially of aluminum.

6. The master alloy hardener of claim 5 wherein said multiple is limited by the requirement that the sum of the concentrations of the alloying elements in said master alloy hardener is less than about 80%.

7. The master alloy hardener of claim 5 wherein said number of alloying elements is in the range of from 2 to 11.

8. The master alloy hardener of claim 5 wherein said number of alloying elements is in the range of from 3 to 8.

9. The master alloy hardener of claim 5 wherein said alloying elements are selected from the group consisting of silicon, magnesium, copper, manganese, chromium, and zinc.

10. The master alloy hardener of claim 5 wherein said multiple is a number from 3 to 10.

11. The master alloy hardener of claim 5 wherein said base alloy is a wrought aluminum alloy.

12. The master alloy hardener of claim 11 wherein said multiple is from 3 to 12.

13. The master alloy hardener of claim 11 wherein said multiple is from 10 to 35.

14. The master alloy hardener of claim 11 wherein said multiple is from 30 to 50.

15. The master alloy hardener of claim 11 wherein said multiple is from 10 to 50.

16. The master alloy hardener of claim 11 said multiple is from 3 to 10.

17. The master alloy hardener of claim 11 wherein said multiple is from 3 to 9.

18. The master alloy hardener of claim 11 wherein said multiple is from 3 to 14.

19. The master alloy hardener of claim 11 wherein said multiple is from 10 to 20.

20. The master alloy hardener of claim 11 wherein said multiple is from 10 to 25.

21. The master alloy hardener of claim 11 wherein said multiple is from 20 to 50.

22. The master alloy hardener of claim 11 wherein said multiple is from 20 to 40.

23. The master alloy hardener of claim 11 wherein said multiple is from 3 to 15.

24. The master alloy hardener of claim 5 wherein said base alloy is a cast or ingot aluminum alloy.

25. The master alloy hardener of claim 24 wherein said multiple is from 3 to 8.

26. The master alloy hardener of claim 24 wherein said multiple is from 3 to 6.

27. The master alloy hardener of claim 24 wherein said multiple is from 3 to 6.

28. The master alloy hardener of claim 24 wherein said multiple is from 2 to 3.

29. A method for converting a first aluminum base alloy to a second, different aluminum base alloy that contains one or more additional alloying elements, said method comprising the step of adding a sufficient amount of a master alloy hardener to said first aluminum base alloy or to a mixture of said first aluminum base alloy and commercially pure aluminum to produce said second aluminum base alloy, wherein said master alloy hardener consists essentially of the alloying elements of said second aluminum base alloy, and wherein said alloying elements are present in said master alloy hardener at concentrations which are a multiple greater than 2 and up to 50 of the concentrations of said alloying elements in said second aluminum base alloy, wherein said alloying elements are selected from the group consisting of silicon, iron, chromium, zinc, copper, magnesium, manganese, nickel, lead, bismuth, zirconium, boron, strontium, titanium, beryllium, sodium, calcium, phosphorous and antimony and mixtures thereof.

30. The master alloy hardener of claim 5 wherein said alloying elements are selected from the group consisting of copper, manganese, magnesium, silicon, chromium, lead, bismuth, zirconium, zinc, iron and nickel.

31. The master alloy hardener of claim 5 wherein said multiple is a number from 3 to 30.

* * * * *